US007234402B2

(12) United States Patent
Olvey et al.

(10) Patent No.: US 7,234,402 B2
(45) Date of Patent: Jun. 26, 2007

(54) FOLDABLY CONSTRUCTED FORCE-RESISTING STRUCTURES

(76) Inventors: Douglas A. Olvey, 1300 Suzanne Way, Longwood, FL (US) 32779; James L. Sketo, 2914 Orchard Walk, Jonesboro, GA (US) 30236

( * ) Notice: Subject to any disclaimer, the term of this patent is extended or adjusted under 35 U.S.C. 154(b) by 0 days.

(21) Appl. No.: 11/368,217

(22) Filed: Mar. 3, 2006

(65) Prior Publication Data

US 2006/0225626 A1 Oct. 12, 2006

Related U.S. Application Data

(60) Provisional application No. 60/658,836, filed on Mar. 4, 2005.

(51) Int. Cl.
*B65D 19/00* (2006.01)

(52) U.S. Cl. ..... 108/51.3

(58) Field of Classification Search ..... 108/51.3, 108/56.1, 57.18, 51.11; 206/386, 595, 596, 206/598, 599, 600

See application file for complete search history.

(56) References Cited

U.S. PATENT DOCUMENTS 2,908,464 A * 10/1959 Traudt et al. ..... 108/51.3
3,000,603 A * 9/1961 Hemann ..... 108/51.3
3,216,376 A * 11/1965 Anderson et al. ..... 108/51.3
3,302,593 A * 2/1967 Roberts ..... 108/51.3
4,875,419 A * 10/1989 Helton et al. ..... 108/56.1
5,285,732 A * 2/1994 Gottlieb ..... 108/51.3
6,029,582 A 2/2000 Ogilvie, Jr. et al.
7,007,613 B2 * 3/2006 Sketo ..... 108/51.3
2006/0248855 A1 * 11/2006 Olvey ..... 52/782.1

FOREIGN PATENT DOCUMENTS

EP 741084 * 11/1996
GB 2397568 * 7/2004

* cited by examiner

*Primary Examiner*—Janet M. Wilkens

(57) ABSTRACT

A foldably constructed force-resisting structure comprises a top member and a bottom member foldably constructed and assembled from one or more blanks of sheet material, preferably corrugated paperboard, initially in a flat condition prior to folding. The bottom member includes a base panel and at least one interior support flap folded from the base panel to provide vertical support for a base panel of the top member disposed at least substantially parallel to the base panel of the bottom member. The top and bottom members may be interlockingly secured in various ways by interengagement of various portions of the one or more blanks themselves.

23 Claims, 20 Drawing Sheets

FOLDABLY CONSTRUCTED FORCE-RESISTING STRUCTURES

CROSS-REFERENCE TO RELATED PATENT APPLICATION

The subject patent application claims priority from prior U.S. Provisional Patent Application Ser. No. 60/658,836 filed Mar. 4, 2005, the entire disclosure of which is incorporated herein by reference.

BACKGROUND OF THE INVENTION

1. Field of the Invention

The present invention relates generally to a force-resisting structure or support and, more particularly, to a force-resisting structure or support foldably constructed from one or more foldable blanks and especially suited for use as a pallet or dunnage support.

2. Brief Discussion of the Related Art

A pallet is primarily used to accommodate the mechanized bulk handling and transport of products. Typically, a pallet comprises a flat, elevated top surface for supporting a load, such as goods, containers, or packages, a sufficient distance above the ground or floor so that the fork of a forklift can be inserted under the top surface in order to move the pallet with the entire load thereon from place to place. Traditionally, most pallets have been made from pieces of wood, specifically soft wood, assembled with metal fasteners such as nails or screws. However, a number of problems face present day users of conventional wooden pallets. The rising cost of making and repairing wooden pallets has detracted from the overall cost effectiveness of palletized shipments. Wooden pallets are heavy, bulky and cumbersome, and empty wooden pallets require substantial storage space. It is especially costly to transport empty wooden pallets by rail or truck for reuse.

To save costs, conventional wooden pallets purchased and used by shippers are ordinarily returned to the shipper for reuse, but since wooden pallets are heavy, bulky and cumbersome, they are inconvenient to store and relatively expensive to return to the shipper. If the wooden pallet is not reused, it must be disposed of in a proper manner. Generally speaking, landfill or other waste disposal sites will not accept wooden pallets as is; rather, the pallets must first be reduced either by chipping or burning prior to disposal. Chipping adds significant cost to wooden pallet disposal, and burning wooden pallets is often precluded by environmental regulations.

In some instances, used wooden pallets can be retrieved by pallet recyclers. Recyclers who retrieve unwanted wooden pallets usually accept only certain sizes of wooden pallets and, most commonly, charge a fee for their retrieval. After repair or refurbishment, the recycler may attempt to resell the used wooden pallets. The market for recycled wooden pallets is limited, however, because many retailers refuse to receive goods transported on recycled wooden pallets due to the lack of any standards regulating the quality of the repair or refurbishment of used wooden pallets. Products shipped internationally on even new wooden pallets are faced with increasing regulations requiring various forms of chemical treatment to the wood to prevent infestation and transport of insects and parasites. Pallets constructed of plastic or metal have been proposed, but plastic and metal pallets have many of the same disadvantages as wooden pallets including being heavy, bulky and cumbersome, being costly and inconvenient to transport, store and dispose of, and being incompatible with environmental preservation. In view of the various drawbacks to pallets made from wood, plastic or metal, it would be desirable to construct a pallet from a material other than wood, plastic or metal, while maintaining many of the desirable characteristics generally associated with pallets made from wood, plastic and metal to provide a pallet that is lighter in weight, less expensive, strong, of simplified construction, easier and less costly to transport and store, that requires less space for storage, that is more readily recyclable or disposable, and that minimizes environmental impact.

A pallet constructed from a readily recyclable material such as corrugated paperboard would be especially desirable. In warehouses and retail stores, separate receptacles are commonly provided for collecting, compacting and/or storing recyclable materials, such as paperboard and plastics. The recyclable materials can then be retrieved, and oftentimes sold, and recycled into new materials and/or products. Corrugated paperboard, which is particularly conducive to being recycled, is typically formed as a layered structure or composite comprising a corrugated medium sandwiched between liner sheets. The corrugated medium forms a series of interconnected arches providing substantial structural strength. For example, a sheet of corrugated paperboard held in a vertical position can support a weight many times greater than its own weight.

Pallets made of corrugated paperboard have been proposed including pallets constructed from foldable corrugated paperboard blanks as represented by U.S. Pat. No. 6,029,582 to Ogilvie, Jr. et al. In many conventional corrugated paperboard pallets, the vertical supports for the elevated top surface of the pallet are secured with extraneous fasteners, including adhesive fasteners such as glue or mechanical fasteners such as staples or clips, and are not secured by the paperboard blanks themselves. Since an individual pallet ordinarily includes a plurality of vertical supports, the need to apply an extraneous fastener to each vertical support adds to the cost, time, labor and complexity involved in constructing or assembling the pallet. Furthermore, paperboard pallets in which the vertical supports are secured with extraneous fasteners are usually lacking in torsional strength. The extraneous fasteners also introduce undesirable materials into the pallet, and the fasteners may limit or complicate recyclability of the pallet. Some paperboard pallets rely on frictional securement of a top member of the pallet, which defines the elevated top surface, to a bottom member of the pallet, and such frictional securements lend little or no torsional support or strength to the overall pallet structure. Many conventional paperboard pallets do not have full perimeter support for the elevated top surface. Consequently, the force from a load carried on the elevated top surface can cause the elevated top surface to deflect in areas where the load is not directly supported by vertical supports of the pallet. Some conventional paperboard pallets cannot be foldably constructed or assembled from a single paperboard blank but, rather, require at least two foldable paperboard blanks that are assembled and then fastened together with extraneous fasteners. Some paperboard pallets attempt to duplicate the design of conventional wooden pallets, and these pallets are usually both heavy and expensive despite being made of paperboard.

Solid paperboard sheets known as slip-sheets are sometimes interposed between a load and a horizontal surface, such as the ground or floor, on which the load is supported. The slip-sheet is typically larger in peripheral size than the footprint of the load thereon thusly presenting an exposed marginal edge of the slip-sheet that can be grasped to slide the slip-sheet with the load thereon along the horizontal surface. Slip-sheets are not structurally or functionally similar to pallets.

A dunnage support is a type of packing conventionally utilized in transporting products. Conventional dunnage supports are ordinarily made of a foam material, and similar problems that arise with respect to the disposal of wooden, plastic and metal pallets also arise after the useful life of a dunnage support has ended. Additionally, the foam material of a conventional dunnage support can be prone to crumbling after a high impact, a characteristic that can lead to damage to both the dunnage support and the product being transported. The lack of a recycling program for foam both adds to the cost of dunnage supports and has caused various industries that utilize dunnage supports to look for dunnage supports that can be made of an alternate material to foam while still maintaining the positive characteristics associated with foam materials.

The need exists, therefore, for improved foldably constructed force-resisting structures or supports constructed from one or more foldable blanks, preferably corrugated paperboard blanks, and especially suited for use as a pallet or as a dunnage support.

SUMMARY OF THE INVENTION

A foldably constructed force-resisting structure comprises a top member and a bottom member each formed as a one piece blank of sheet material or formed together as a one piece blank of the sheet material. The top and bottom members are initially in a flat or planar condition prior to being foldably constructed or assembled into the force-resisting structure. The sheet material is preferably corrugated paperboard. The top member comprises a top member base panel having a perimeter defined by a plurality of side edges, and the bottom member comprises a bottom member base panel having a perimeter defined by a plurality of side edges in correspondence with the side edges of the top member base panel. The bottom member includes at least one interior support flap within the perimeter of the bottom member base panel and foldably connected to the bottom member base panel along a support flap fold line. The interior support flap includes an attached flap segment foldably connected to the bottom member base panel at the support flap fold line and at least one separable flap segment foldably connected to the attached flap segment at a segment fold line perpendicular to the support flap fold line. The entire support flap is folded outwardly or upwardly from the bottom member base panel along the support flap fold line to a position at least substantially perpendicular to the bottom member base panel. The separable flap segment is independently foldable along the segment fold line relative to the attached flap segment and the bottom member base panel to an angled position where the separable flap segment is at an angle to the attached flap segment. The separable flap segment may be provided with a locking formation to interlock with the bottom member base panel in the angled position. The interior support flap provides vertical support for the top member base panel when it is disposed over the bottom member base panel in at least substantially parallel relation therewith. The top member base panel defines an elevated top surface of the force-resisting structure for supporting a load thereon.

The bottom member can have a plurality of interior support flaps foldably connected to the bottom member base panel. The plurality of interior support flaps may include one or more central interior support flaps located toward the center or middle of the bottom member base panel and one or more outer interior support flaps located toward the sides of the bottom member base panel. The separable flap segments of different interior support flaps may be interlocking secured to one another. The separable flap segments may be interlockingly secured to other portions of the top member and/or the bottom member. The plurality of interior support flaps may be arranged to form an interior vertical support structure or assembly of various configurations when the support flaps are folded to the angled position.

In one embodiment of the force-resisting structure in which the top and bottom members are each formed as a separate blank, the top member includes at least one side portion foldably connected to a side edge of the top member base panel and having an access opening therein and/or the top member includes at least one retention element foldably connected to a side edge of the top member base panel. Where the top member includes a side portion with an access opening, the bottom member includes a retention element foldably connected to a side edge of the bottom member base panel in correspondence with the access opening of the top member. Where the top member includes a retention element, the bottom member includes a side portion foldably connected to a side edge of the bottom member base panel and having an access opening in correspondence with the retention element of the top member. During foldable construction of the force-resisting structure, the retention element is interlockingly engaged with the access opening to interlockingly secure the top and bottom members together, with the base panels in at least substantially parallel relation. The retention element preferably includes at least one foldable wing that extends at least substantially perpendicularly between the base panels with a snug fit to provide vertical support for the top member base panel. The side portion is preferably provided with a side wall flap foldable relative to a side wall of the side portion to expose the access opening. The side wall flap extends at least substantially perpendicularly between the base panels with a snug fit to provide vertical support for the top member base panel. Vertical support for the top member base panel is also provided by the vertical support structure formed by one or more interior support flaps folded from the bottom member base panel. The side portion may include a tuck flap foldable from the side wall to a position at least substantially parallel to the top and bottom member base panels and confined between the base panels by the wing, the side wall flap and/or an interior support flap. It is preferred that the force-resisting structure be provided with a plurality of access openings appropriately located to receive the lifting mechanism of a variety of lifting equipment, allowing the force-resisting structure to be lifted and moved from place to place with a load supported on the top member base panel.

In an alternative embodiment of the foldably constructed force-resisting structure in which the top and bottom members are formed together as a single blank, a side wall is foldably connected to a side edge of the bottom member base panel, and the top member base panel is foldably connected to the side wall. The side wall is folded upwardly from the bottom member base panel to a position at least substantially perpendicular to the bottom member base panel, and the top member base panel is folded from the side wall to be disposed over the bottom member base panel in at least substantially parallel relation therewith. The bottom member includes at least one interior support flap folded upwardly from the bottom member base panel to provide vertical support for the top member base panel. Preferably, the bottom member further includes a side portion foldably connected to another edge of the bottom member base panel, the side portion comprising a side wall foldably connected to the edge of the bottom member base panel and a tuck flap foldably connected to the side wall. The side wall of the side portion is folded upwardly from the bottom member base panel to a position at least substantially perpendicular to the bottom member base panel, and the tuck flap is folded inwardly from the side wall of the side portion to a position at least substantially parallel to the bottom member base panel. The tuck flap is supported on an interior support flap folded upwardly from the bottom member base panel and/or on a side wall flap folded from the side wall of the side portion to expose an access opening. The top member base panel is disposed over the tuck flap, with the tuck flap being confined between the top member base panel and the interior support flap and/or side wall flap.

In a further alternative embodiment of a foldably constructed force-resisting structure in which the top and bottom members are formed together as a single blank, the bottom member comprises a bottom member base panel having opposed side edges and opposed side walls foldably connected to the opposed side edges. The top member comprises a base panel divided into first and second top member base panel portions. The first top member base panel portion is foldably connected to one of the side walls of the bottom member, and the second top member base panel portion is foldably connected to the other side wall of the bottom member. The side walls are folded upwardly from the bottom member base panel to a position at least substantially perpendicular to the bottom member base panel. The first and second top member base panel portions are folded from the respective side walls to be disposed over the bottom member base panel in at least substantially parallel relation therewith. The first and second top member base panel portions are supported by one or more interior support flaps folded upwardly from the bottom member base panel to a position at least substantially perpendicular to the bottom member base panel. Terminal edges of the first and second top member base panel portions are disposed adjacent one another over the bottom member base panel, and the first and second top member base panel portions cooperate to form a top member base panel that defines an elevated top surface of the force-resisting structure. Insertion flaps are foldably connected to the terminal edges of the first and second top member base panel portions and are folded inwardly from such edges to extend into the interior of the force-resisting structure at least substantially perpendicularly between the top and bottom member base panels. The side walls that foldably connect the bottom member base panel to the first and second top member base panel portions may be provided with side wall flaps foldable from the side walls to expose access openings. The side wall flaps are folded from the side walls to be disposed at least substantially perpendicularly between the top and bottom member base panels with a snug fit to provide vertical support for the top member base panel. The bottom member may further include side portions foldably connected to the remaining opposed edges of the bottom member base panel, each side wall portion including a side wall foldably connected to the side edge of the bottom member base panel and a tuck flap foldably connected to the side wall. The side walls of the side portions are folded upwardly from the bottom member base panel to a position at least substantially perpendicular to the bottom member base panel, and the tuck flaps are folded inwardly from the side walls of the side portions to a position at least substantially parallel to the bottom member base panel. Preferably, the side walls of the side portions have side wall flaps foldably connected thereto, the side wall flaps being folded from the side walls of the side portions to expose access openings and provide vertical support for the tuck flaps. The tuck flaps preferably have slots or apertures therein for receiving the insertion flaps of the first and second top member base panel portions. The first and second top member base panel portions may have side portions foldably connected thereto and including side walls folded from the first and second top member base panel portions to overlap the side walls of the bottom member. The side walls of the first and second top member base panel portions preferably have side wall flaps folded therefrom to expose access openings aligned with the access openings of the bottom member. The side wall flaps associated with the access openings of the first and second top member base panel portions may interlockingly engage with the access openings of the bottom member.

In an additional alternative force-resisting structure in which the top and bottom members are each formed of a separate one piece blank, the top member comprises a base panel and a plurality of side walls folded downwardly from the top member base panel to define a peripheral side wall along the perimeter of the top member base panel. The bottom member comprises a bottom member base panel and a plurality of side walls folded upwardly from the bottom member base panel to define a peripheral side wall along the perimeter of the bottom member base panel. The bottom member base panel has at least one interior support flap foldably connected to the bottom member base panel. The interior support flap includes an attached flap segment foldably connected to the bottom member base panel at a support flap fold line and two separable flap segments foldably connected to opposite ends of the attached flap segment along segment fold lines perpendicular to the support flap fold line. The interior support flap is folded upwardly from the bottom member base panel along the support flap fold line to a position at least substantially perpendicular to the bottom member base panel. The separable flap segments are folded along their segment fold lines relative to the attached flap segment and the bottom member base panel to a position where each separable flap segment is disposed at an angle to the attached flap segment. The top and bottom members are assembled in nested relation with the top member base panel at least substantially parallel to the bottom member base panel. The interior support flap provides vertical support for the top member base panel.

Various objects, features and advantages of the present invention will become apparent from the following description of the preferred embodiments taken in conjunction with the accompanying drawings wherein like reference numerals refer to like or similar parts.

DESCRIPTION OF THE PREFERRED EMBODIMENTS

Figure 1:
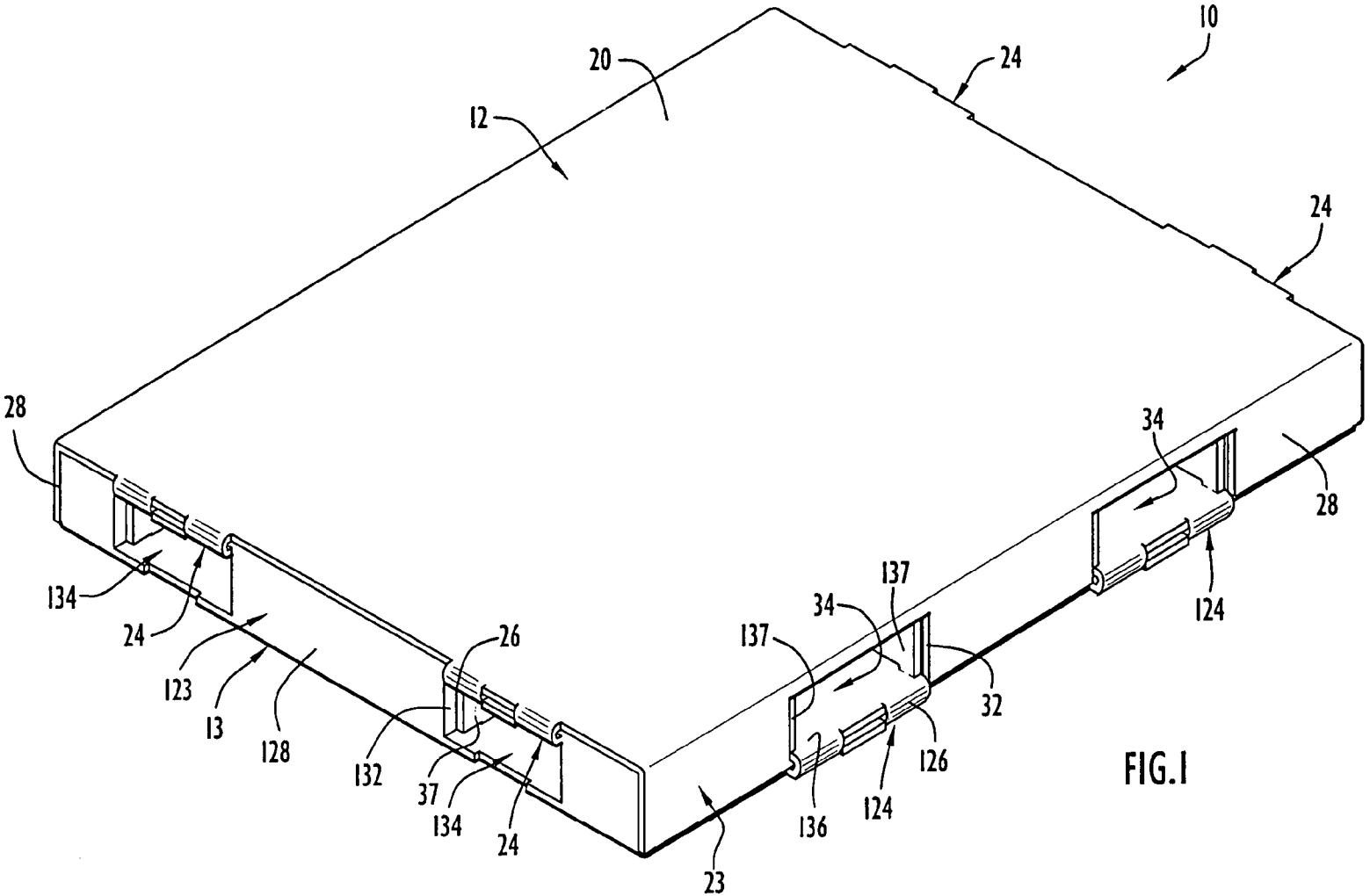
FIG. 1 is a perspective view of a foldably constructed force-resisting structure according to the present invention.
Figure 2:
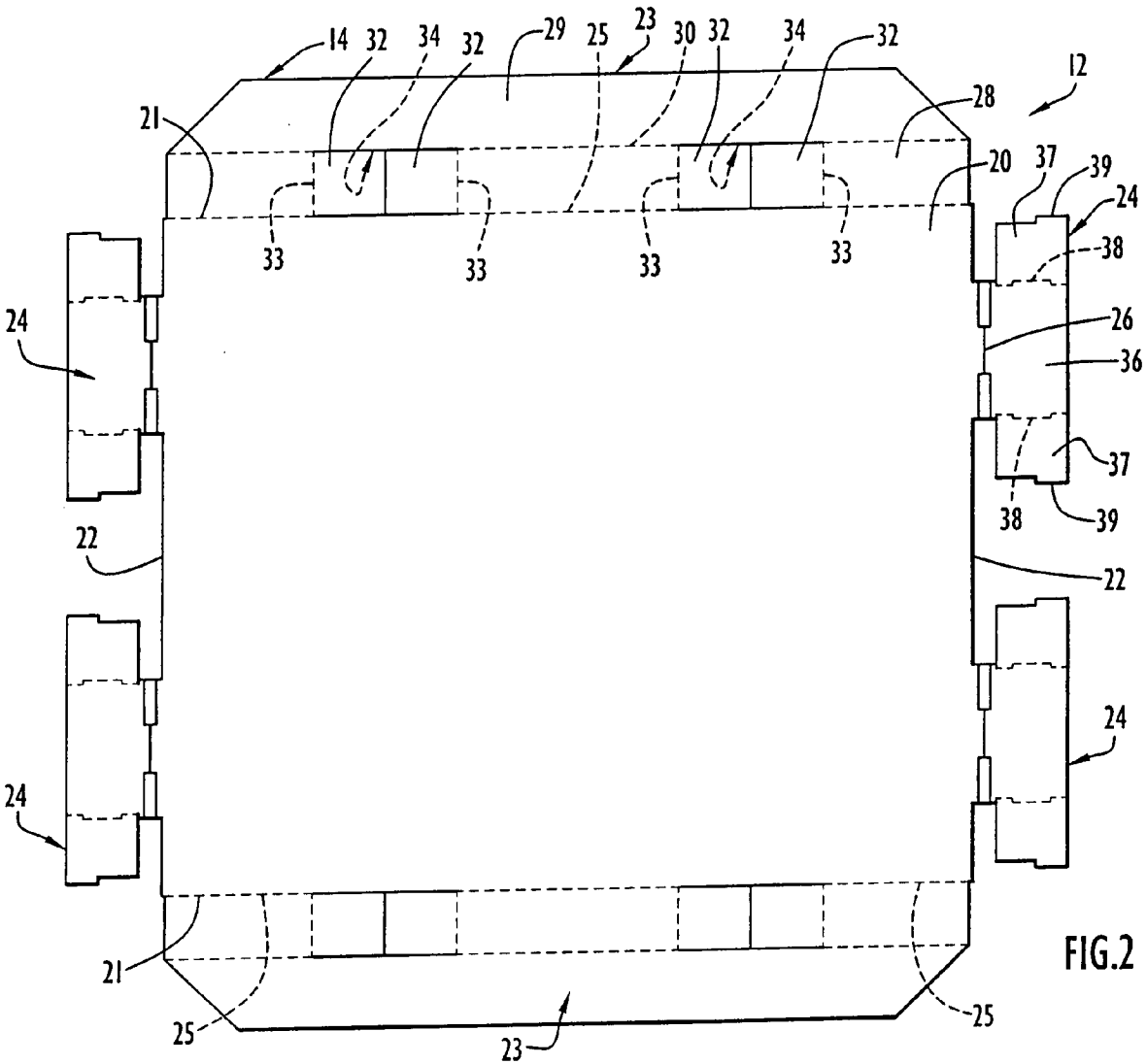
FIG. 2 is a plan view of a first or top member of the foldably constructed force-resisting structure of FIG. 1 prior to being foldably constructed.
Figure 3:
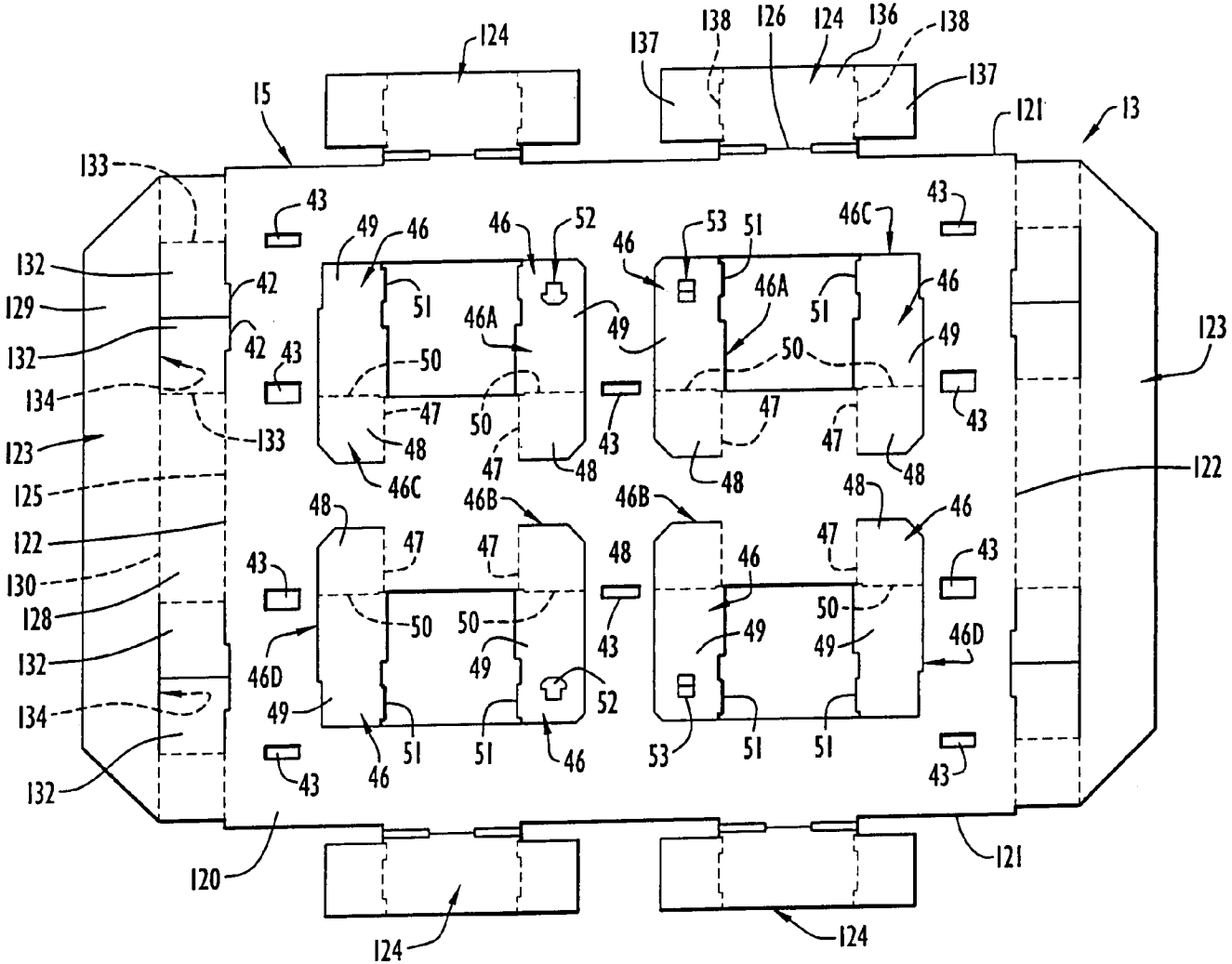
FIG. 3 is a plan view of a second or bottom member of the foldably constructed force-resisting structure of FIG. 1 prior to being foldably constructed and assembled to the top member.

A foldably constructed or assembled force-resisting structure or support 10 according to the present invention is illustrated in FIG. 1. The force-resisting structure 10 comprises a first or top member 12 and a second or bottom member 13 assembled to the top member 12. Prior to being foldably constructed or assembled, the top member 12 is in an unfolded condition comprising a first or top member blank 14 as depicted in FIG. 2. Prior to being foldably constructed or assembled, the bottom member 13 is in an unfolded condition comprising a second or bottom member blank 15 as depicted in FIG. 3. The blanks 14 and 15 are each flat or planar in the unfolded condition, each blank 14 and 15 being formed integrally and unitarily or monolithically as a single piece of sheet material. Preferably, the sheet material from which blanks 14 and 15 are made is paperboard and, most preferably, corrugated paperboard. However, thermal plastics and ductile metals could be used as the sheet material. The blanks 14 and 15 can each be cut in any suitable manner from the sheet material, such as by die or stamp cutting. The blanks 14 and 15 can be treated in various ways to make them suitably moisture and water resistant. The blanks 14 and 15 can be made from virgin materials or from recycled materials. The blanks 14 and 15 can be manufactured at the site of construction and/or use of the force-resisting structure 10. The blanks 14 and 15 are easily and routinely recyclable while maintaining many of the desirable characteristics of less readily recyclable materials such as wood, metal and various plastics.

Figure 4:
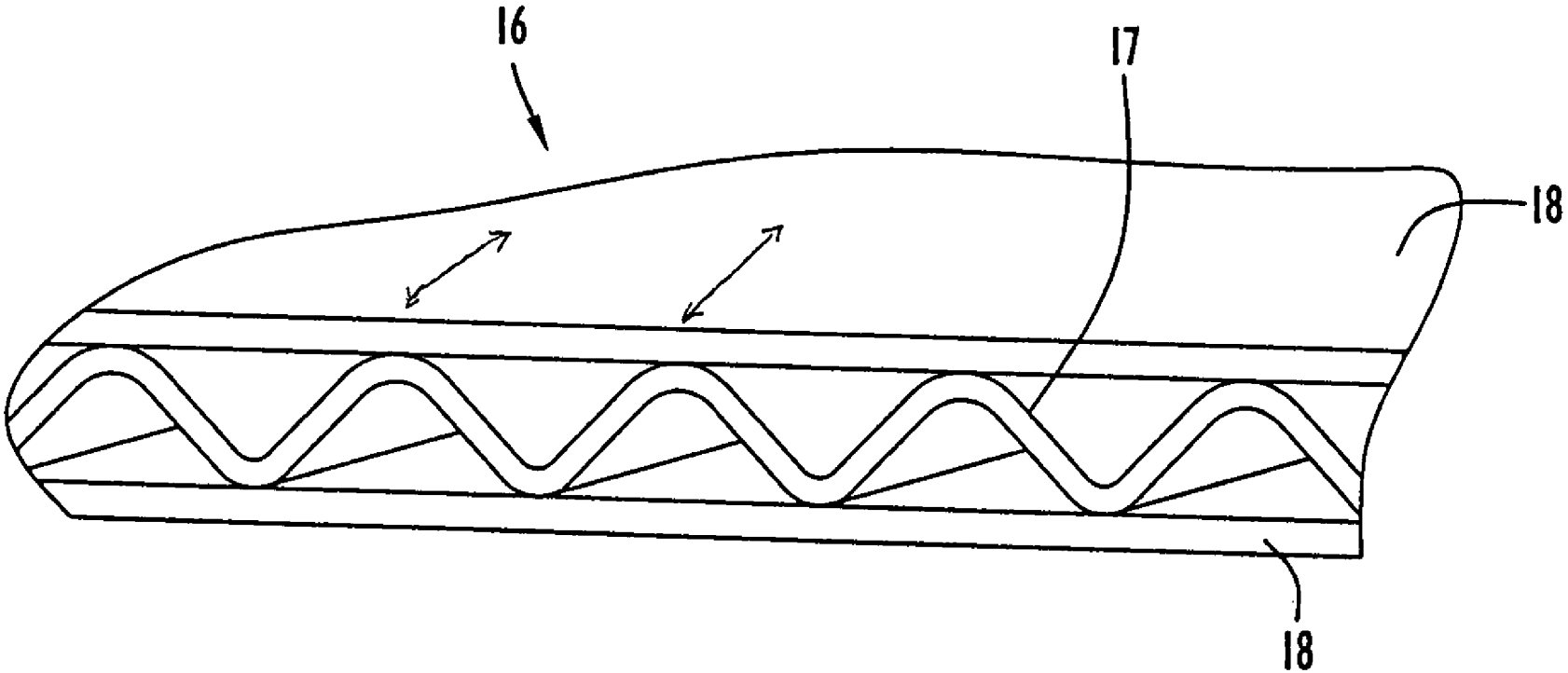
FIG. 4 is a broken perspective view depicting a preferred sheet material for the top and bottom members.

FIG. 4 illustrates a corrugated paperboard 16 from which blanks 14 and 15 are preferably made. Corrugated paperboard 16 comprises a corrugated medium 17 held or sandwiched between liner sheets 18. The corrugated medium 17, which is typically made from a short fiber paper, is configured with flutes or pleats forming interconnected arches. The flutes or pleats extend lengthwise along parallel lines of corrugation as shown by arrows in FIG. 4. The arches are typically glued to the liner sheets 18, which are normally made of puncture resistant paper. Corrugated paperboard used for blanks 14 and 15 can be manufactured in various ways. Corrugated paperboard used for blanks 14 and 15 can be treated in various ways including chemical cooking processes, surface treatment including but not limited to flame treatment, and/or coating processes.

As explained further below, each blank 14 and 15 has foldable portions foldable along fold or crease lines defined or formed in the blanks in order to foldably construct or assemble the top and bottom members 12 and 13. Each blank 14 and 15 is provided, where necessary, with cut lines creating separable edges in the blanks for various purposes including to define or form the foldable portions and/or other structural elements, and/or to allow for or facilitate folding of the foldable portions. The cut lines can be formed as complete cuts extending entirely through the thickness of the sheet material to form completely severed separable edges. Alternatively, the cut lines can be formed as partial cuts, such as perforations or score lines, extending partly through the thickness of the sheet material to form partly severed separable edges that can be severed completely during foldable construction or assembly. Either or both blanks 14 and 15 may have one or more cut-out windows of various shapes and sizes where the sheet material is completely removed or is completely removed during foldable construction or assembly to serve various purposes. Some of the purposes that may be served by the provision of cut-out windows include simplifying the manufacture or preparation of the blanks, facilitating foldable construction or assembly of the force-resisting structure, allowing for interlocking engagement between portions of the same or different blanks, and reducing weight when possible without sacrificing necessary structural strength. The peripheral dimensions and thickness of the blanks 14 and 15 and the location of the fold lines, cut lines and cut-out windows can vary in accordance with the features desired for the force-resisting structure 10 based on its intended application.

Top member 12 and its blank 14, as best shown in FIG. 2, comprises a top member base panel 20 demarcated or circumscribed by a plurality of side edges including opposed first side edges 21 and opposed second side edges 22. The top member 12 further comprises at least one side portion 23 foldably connected to the base panel 20 along a side edge thereof and/or at least one locking or retention element 24 foldably connected to the base panel 20 along a side edge thereof. The base panel 20 can have various peripheral configurations and/or sizes as demarcated or circumscribed by first side edges 21 and second side edges 22 in accordance with the dimensions desired for the force-resisting structure 10. In the case of force-resisting structure 10, the base panel 20 has a rectangular peripheral configuration. Accordingly, the first side edges 21 are longer than the second side edges 22 and are parallel to one another. The second side edges 22 are parallel to one another and are perpendicular to the first side edges 21.

The top member 12 is depicted with opposed side portions 23, there being a side portion 23 foldably connected to the base panel 20 along each first side edge 21. Each side portion 23 is formed in blank 14 as an extension to the base panel 20, and the first side edge 21 along which the side portion 23 is foldably connected to the base panel 20 comprises a side portion fold or crease line 25 in blank 14. The fold lines 25 preferably extend the entire or substantially the entire length of first side edges 21. It should be appreciated that a side portion 23 can be provided along either or both first side edges 21 and/or along either or both second side edges 22.

The top member 12 is depicted with opposed retention elements 24, there being at least one retention element 24 foldably connected to the base panel 20 along each second side edge 22. In particular, the top member 12 is shown with two retention elements 24 foldably connected to the base panel 20 along each second side edge 22. Each retention element 24 is formed in blank 14 as an extension to the base panel 20 and is foldably connected to the base panel 20 at a retention element fold or crease line 26 defined in blank 14 along the second side edge 22. It should be appreciated that the top member 12 can have one or more retention elements 24 along either or both second side edges 22 and/or along either or both first side edges 21. In the case of force-resisting structure 10, each second side edge 22 has its retention elements 24 located directly opposite the retention elements 24 on the opposite second side edge 22. It should be appreciated, however, that one side edge can have one or more retention elements 24 situated at different opposed locations from one or more retention elements 24 on the opposite side edge such that the opposed retention elements do not have to be exactly or directly opposite one another. As explained further below, each retention element 24 of the top member 12 interlocks with a corresponding access opening in a side wall of the bottom member 13 when the top and bottom members are foldably constructed and assembled to one another.

Each side portion 23 comprises a side wall 28 and a tuck flap 29. The side wall 28 is foldably connected to the base panel 20 at the corresponding side portion fold or crease line 25, which may be considered an inner side wall fold or crease line, and the tuck flap 29 is foldably connected to the side wall 28 at a tuck flap or outer side wall fold or crease line 30 defined in blank 14. The tuck flap fold line 30 is parallel to the fold line 25, and an outer side edge of the tuck flap 29 is parallel to the fold lines 30 and 25. Preferably, the tuck flap fold line 30 extends the majority of the length of fold line 25, the tuck flap fold line 30 being depicted as being the same or substantially the same length as the fold line 25. The outer side edge of the tuck flap 29 is preferably shorter in length than the tuck flap fold line 30, with the tuck flap having beveled end edges extending angularly inwardly from the ends of the tuck flap fold line 30 to the outer side edge of the tuck flap.

At least one side wall flap 32 is provided in a side wall 28 for folding relative to the side wall along a side wall flap fold or crease line 33 to present, reveal or expose an access opening 34 in the side wall as explained further below. Preferably, a pair of side wall flaps 32 are provided in at least one side wall 28 and cooperate to expose an access opening 34 in the side wall. More particularly, each side wall 28 of top member 12 has two pairs of side wall flaps 32 with each pair of side wall flaps 32 cooperating to expose an access opening 34. The top member 12 is thusly depicted as having opposed access openings 34, there being at least one access opening 34 in each side wall 28, with each access opening being exposable by folding of a pair of side wall flaps 32 relative to the side wall. The pairs of side wall flaps 32 in one side wall 28 are located directly opposite the pairs of side wall flaps 32 in the opposite side wall 28 such that the access openings 34 in one side wall 28 are located directly opposite the access openings 34 in the opposite side wall 28. However, it should be appreciated that the pairs of side wall flaps 32 and the access openings 34 in one side wall 28 do not have to be located directly or exactly opposite the pairs of side wall flaps 32 and the access openings 34 in the opposite side wall 28. In other words, the access opening 34 exposable in one side wall 28 by folding of one or more side wall flaps 32 does not have to be directly or exactly opposite an opposed access opening 34 exposable in the opposite side wall 28 by folding of one or more side wall flaps 32. As described further below, each access opening 34 in the top member 12 interlocks with a corresponding retention element of the bottom member 13 when the top and bottom members are foldably constructed and assembled to one another.

Each side wall flap 32 has an inner side edge adjacent, close to or along the fold line 25 and an outer side edge adjacent, close to or along the fold line 30. The fold line 33 for each side wall flap 32 extends perpendicularly between the inner and outer side edges of the side wall flap. Each side wall flap 32 is foldably connected to the corresponding side wall 28 along the fold line 33 and is formed or defined in blank 14 by a cut line, which also forms the access opening 34. Where an access opening 34 is exposed in its entirety by folding of a single side wall flap 32 relative to the corresponding side wall 28, the side wall flap 32 preferably is about the same size as the access opening 34, and the access opening is circumscribed by the fold line 33 and by the edges which result from cutting the blank 14 to form the side wall flap. Where an access opening 34 is exposed by folding two side wall flaps 32 relative to the corresponding side wall 28, as depicted for top member 12, the two side wall flaps 32 together are preferably about the same size as the access opening 34, and the access opening is circumscribed by the fold lines 33 of both side wall flaps 32 and by the edges which result from cutting blank 14 to form the side wall flaps. In the top member 12, each side wall flap 32 is about one half the size of the corresponding access opening 34, and the side wall flaps 32 of each pair are foldable along their fold lines 33 in outward opposition to one another to expose the access opening. The side wall flaps 32 of the top member 12 could be configured with locking tabs or formations for interlocking securement with locking apertures or structures on the top or bottom members as described in greater detail below for the side wall flaps of the bottom member 13.

Each retention element 24 comprises a retention flap 36 and at least one wing 37 foldably connected to one end of the retention flap. The retention flap 36 has an inner side edge foldably connected to base panel 20 along the corresponding retention element fold line 26. The wing 37 is foldably connected to the retention flap 36 at a wing fold or crease line 38 extending perpendicular to the fold line 26. The wing fold line 38 extends from an end of the fold line 26 to an outer side edge of the retention element 24 that is parallel to the second side edge 22 and to the fold line 26. The outer side edge of the retention element 24 defines an outer side edge of the retention flap 36, parallel to the inner side edge of the retention flap, and defines an outer side edge of the wing 37. The outer side edge of the wing 37 extends laterally from the fold line 38, and the wing 37 has an inner side edge that extends laterally from the fold line 38 in parallel with the second side edge 22 and the outer side edge of the wing but close to the fold line 26. The wing 37 also has an end edge extending perpendicularly between its outer and inner side edges in parallel with the fold line 38. The wing 37 may be configured with a locking tab or formation 39 along its end edge for reception in a locking slot or aperture in the bottom member 13 as described below. The fold line 26 for each retention element 24 may comprise separate folds or creases formed in blank 14 and separated or spaced from one another by a desired distance.

The top member 12 is depicted with each retention element 24 comprising more than one wing 37. In particular, each retention element 24 of top member 12 is depicted as comprising two wings 37 extending laterally in opposite directions from the opposite ends of the retention flap 36, with each wing 37 being foldably connected to the retention flap 36 along a wing fold line 38. The wings 37 of each retention element 24 are essentially mirror images of one another with their fold lines 38 being parallel.

Bottom member 13 and its blank 15, as best shown in FIG. 3, comprises a bottom member base panel 120 demarcated or circumscribed by a plurality of side edges in correspondence with the side edges of the top member base panel 20. The base panel 120 has opposed first side edges 121 in correspondence with the first side edges 21 of the top member base panel 20 and opposed second side edges 122 in correspondence with the second side edges 22 of the top member base panel 20. The bottom member 13 further comprises at least one side portion 123 foldably connected to the base panel 120 along a side edge thereof to provide an access opening in the bottom member 13 to interlock with a retention element 24 in the top member 12 and/or the bottom member 13 comprises at least one locking or retention element 124 foldably connected to the base panel 120 along a side edge thereof to interlock with an access opening 34 in the top member 12. The base panel 120 is similar to the base panel 20 and can have various peripheral configurations and/or sizes in accordance with the dimensions of the top member base panel 20.

The side portion 123 of the bottom member 13 is located along a side edge of base panel 120 that corresponds to the side edge of base panel 20 associated with a retention element 24. An access opening 134 in the side wall 128 of side portion 123 is located in correspondence with the retention element 24. The bottom member 13 is depicted with opposed side portions 123, there being a side portion 123 foldably connected to the base panel 120 along each second side edge 122. Each side portion 123 is similar to the side portion 23 and is foldably connected to the base panel 120 at an inner side wall fold or crease line 125 formed or defined in blank 15 along the second side edge 122. Each side portion 123 comprises a side wall 128 foldably connected to the base panel 120 at the corresponding fold line 125, and a tuck flap 129 foldably connected to the side wall 128 at a tuck flap or outer side wall fold or crease line 130 as explained above for side portion 23.

The access opening 134 in the side wall 128 of side portion 123 is exposable by folding of one or more side wall flaps 132, each side wall flap 132 being foldably connected to the side wall 128 along a side wall flap fold line 133. The bottom member 13 is depicted with two access openings 134 in the side wall 128 of each side portion 123, with each access opening 134 being exposable by folding two side wall flaps 132 relative to the corresponding side wall 128 as described above for the access opening 34. The access openings 134 in one side wall 128 are located in correspondence with the retention elements 24 along one side edge 22 of base panel 20, and the access openings 134 in the other side wall 128 are located in correspondence with the retention elements 24 along the opposite side edge 22 of the base panel 20. Each side wall flap 132 is depicted as having a locking tab or formation 42 along its inner side edge for being received in a slot or aperture 43 in base panel 120 when the bottom member 13 is foldably constructed as explained further below. It should be appreciated, however, that the locking tab 42 can be provided along an outer side edge of the side wall flap 132 and that the aperture 43 can be provided in the tuck panel 129 to receive the locking tab 42 during foldable construction of the bottom member 13 as will be evident from the description set forth below. It should be appreciated that the side wall flaps 32 of the top member 12 could be provided with similar locking tabs or formations and that similar slots or apertures can be provided in the base panel 20 or, more preferably, the tuck panel 29 of the top member 12, to receive the locking tabs or formations when the top member 12 is foldably constructed.

The retention element 124 of the bottom member 13 is foldably connected to the base panel 120 along a side edge of the base panel 120 that corresponds to a side edge of base panel 20 associated with an access opening 34, and the retention element 124 is located along this side edge of the base panel 120 in correspondence with the location of the access opening 34. The bottom member 13 is depicted with opposed retention elements 124, there being two retention elements 124 foldably connected to the base panel 120 along each first side edge 121 in correspondence with the access openings 34 of top member 12. Each retention element 124 is similar to retention element 24 and comprises a retention flap 136 foldably connected to the side edge of base panel 120 along a retention element fold or crease line 126 and at least one wing 137 foldably connected to the retention flap 136 along a wing fold line 138. Each retention element 124 is depicted as having two wings 137 foldably connected to the retention flap 136 along fold lines 138 as described above for retention element 24.

Bottom member 13 further includes one or more interior support flaps 46, each support flap 46 being foldably connected to base panel 120 along a support flap fold or crease line 47 and being disposed within the confines of the perimeter of the base panel 120. Each interior support flap 46 comprises a first or attached flap segment 48 foldably connected to the base panel 120 along the fold line 47 and a second or separable flap segment 49 foldably connected to the attached flap segment 48 along a segment fold or crease line 50 defined in support flap 46 perpendicular to the fold line 47, but with the separable flap segment 49 being separable from the base panel 120. Preferably, the separable flap segment 49 is of greater length than the attached flap segment 48. The entire support flap 46 is foldable relative to the base panel 120 along the fold line 47, and the separable flap segment 49 is thereafter independently foldable along the segment fold line 50 relative to the attached flap segment 48 and the base panel 120 to form a vertical support structure within the interior of the force-resisting structure 10 as explained further below.

Support flap 46 has an inner side edge with an attached edge portion foldably connected to the base panel 120 along the fold line 47 and a separable edge portion separable from the base panel 120 along the separable flap segment 49. The segment fold line 50 meets the fold line 47 where the attached edge portion of the inner side edge meets the separable edge portion of the inner side edge. Support flap 46 has an outer side edge separable from the base panel 120 along the attached and separable flap segments 48 and 49, and the outer side edge of the flap 46 is primarily parallel to the inner side edge of the flap 46. The support flap 46 has opposed end edges extending, preferably perpendicularly, between the outer and inner side edges of the flap 46, and outer corners of the end edges may be beveled or angled. The end edges of the flap 46 are separable from the base panel 120. The end edges, the outer side edge and the separable edge portion of the inner side edge of the interior support flap 46 can be made separable from the base panel 120 by forming an appropriate cut line in the blank 15. The interior support flap 46 is arranged in the base panel 120 with its outer and inner side edges and fold line 47 parallel to second side edges 122 and with its end edges and segment fold line 50 perpendicular to second side edges 122. However, the interior support flap 46 can be arranged in the base panel 120 in various ways. The separable flap segment 49 may be configured with a locking tab or formation 51 along the separable edge portion of its inner side edge for reception in a locking slot or aperture 43 in the base panel 120 as described further below.

The bottom member 13 is depicted with a plurality of interior support flaps 46 including a first pair of central interior support flaps 46A located toward the center of base panel 120, a second pair of central interior support flaps 46B located toward the center of base panel 120, outer interior support flaps 46C respectively located between the central flaps 46A and the second side edges 122 of base panel 120, and outer interior support flaps 46D respectively located between the central flaps 46B and the second side edges 122 of base panel 120. During formation of the support flaps 46A, 46B, 46C and 46D in blank 15 by cutting, cut-out windows may result in blank 15 between support flaps 46A and 46C and between support flaps 46B and 46D as seen in FIG. 3.

Figure 5:
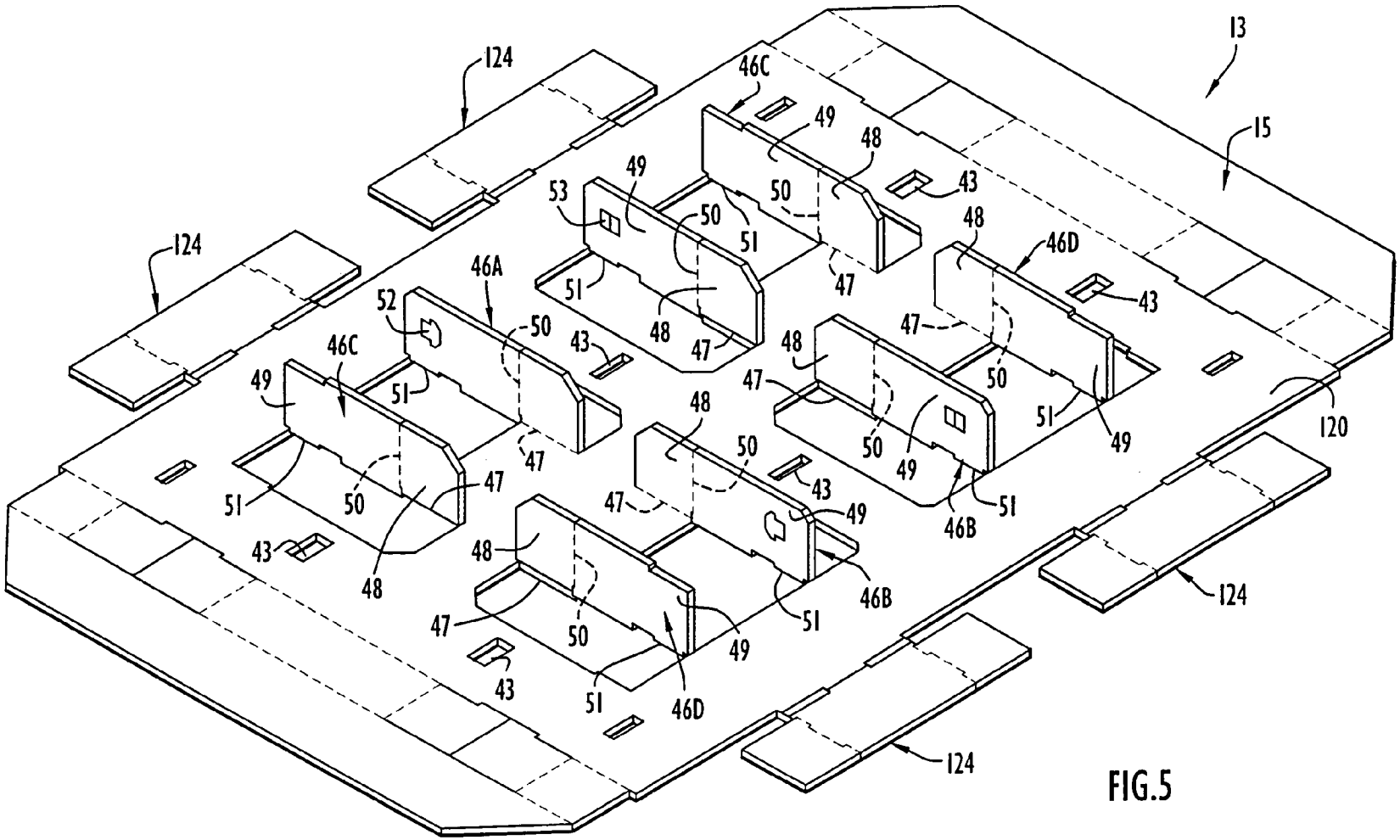
FIG. 5 is a perspective view of the bottom member showing interior support flaps of the bottom member folded relative to a base panel of the bottom member.
Figure 6:
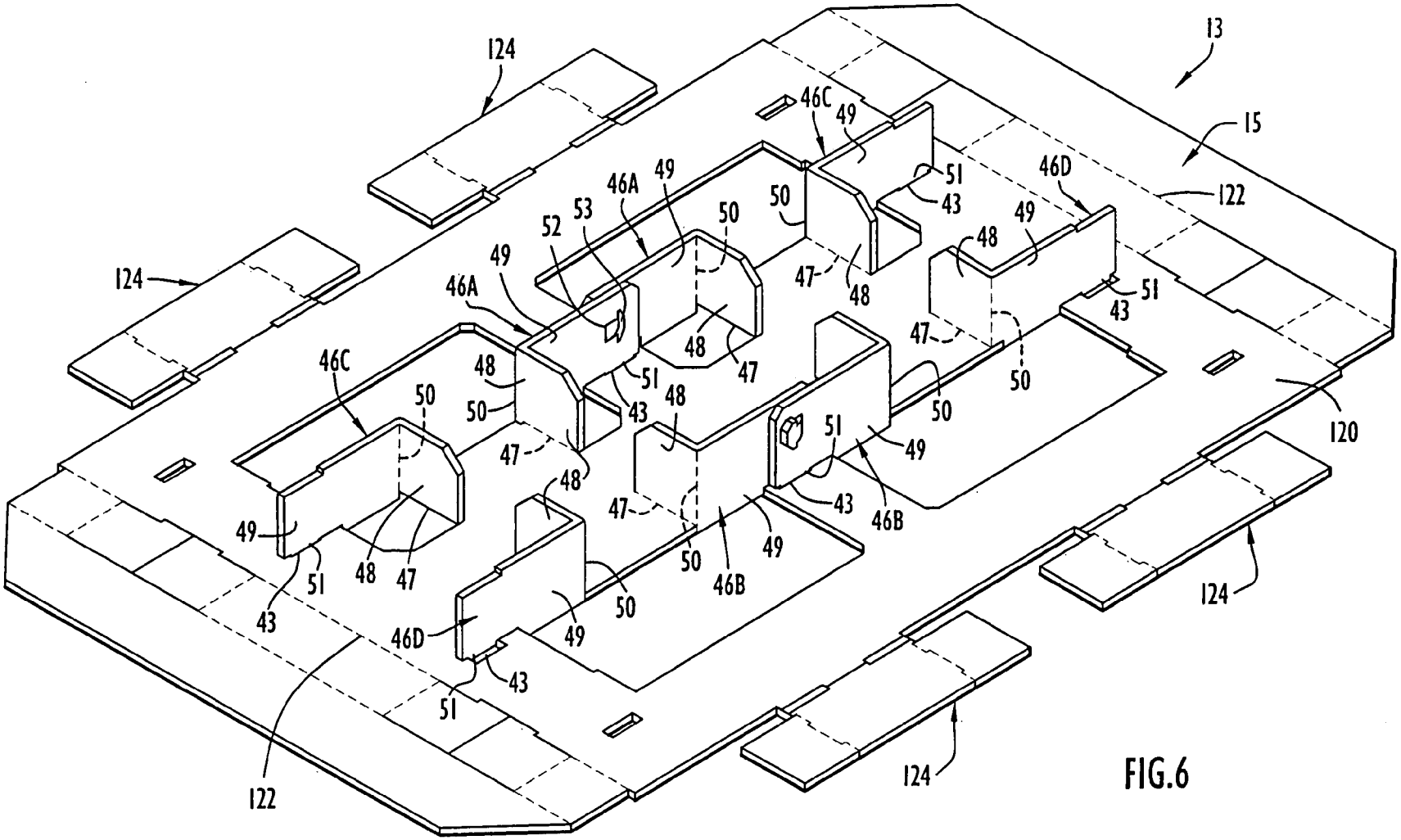
FIG. 6 is a perspective view of the bottom member showing a separable flap segment of each interior support flap folded relative to an attached flap segment of the interior support flap and relative to the base panel of the bottom member.

The fold lines 47 for central flaps 46A are parallel to each other and to second side edges 122. The separable flap segments 49 of the central flaps 46A extend from the attached flap segments 48 thereof toward a first side edge 121. In the unfolded condition for central flaps 46A, the segment fold lines 50 of flaps 46A extend inwardly toward each other and are aligned or substantially aligned longitudinally with one another in the plane of blank 15. The central flaps 46A are foldable outwardly or upwardly from the base panel 120 in opposition or in a direction away from one another along their fold lines 47 to assume a position where the flaps 46A are parallel or substantially parallel to one another and perpendicular or substantially perpendicular to base panel 120 as seen in FIG. 5. The separable flap segments 49 of the flaps 46A are thereafter independently foldable inwardly toward one another along their fold lines 50 relative to their attached flap segments 48 and base panel 120 to assume an angled position where the separable flap segments 49 extend toward each other and are disposed at an angle to the attached flap segments 48 as seen in FIG. 6. In the angled position, the attached flap segments 48 remain parallel or substantially parallel to one another, the attached flap segments 48 and the separable flap segments 49 remain perpendicular or substantially perpendicular to the base panel 120, and the separable flap segments 49 define a right angle or substantially a right angle with their attached flap segments 48. When the separable flap segments 49 of the flaps 46a are folded to the angled position, the locking tabs 51 on the separable flap segments 49 can be inserted into the aperture 43 located in base panel 120 between the attached flap segments 48 of flaps 46A, and the locking tabs 51 of both separable flap segments 49 can be inserted into the same aperture 43 to interlockingly secure the separable flap segments to the base panel 120 as shown in FIG. 6. The aperture 43 for the locking tabs 51 of the flaps 46A is located in line with or generally in line with fold lines 50 of the flaps 46A as seen in FIG. 3. The interlocking securement between the separable flap segments 49 and the base panel 120 may be releasable in that the locking tabs 51 may be removable from the aperture 43.

The separable flap segments 49 of the support flaps 46A are of sufficient length such that ends of the separable flap segments 49 overlap one another when the separable flap segments 49 are folded to the angled position. The end of the separable flap segment 49 of one support flap 46A may be provided with a securing element or formation 52, and the end of the separable flap segment 49 of the other support flap 46A may be provided with a securing element receptor 53 for cooperative engagement with the securing element 52 to interlockingly secure the overlapping ends of the separable flap segments 49 together as illustrated in FIG. 6. The cooperative engagement between securing element 52 and the securing element receptor 53 may be a releasable cooperative engagement to allow the overlapping ends of the separable flap segments 49 to be selectively released from one another.

The second pair of central interior support flaps 46B are similar to the first pair of central interior support flaps 46A except that the separable flap segments 49 of the central flaps 46B extend from their attached flap segments 48 toward the opposite first side edge 121 of base panel 120. The fold lines 47 for central flaps 46B are aligned or substantially aligned longitudinally with the respective fold lines 47 of central flaps 46A. As depicted in FIGS. 5 and 6, the central flaps 46B are foldable outwardly or upwardly from the base panel 120 along their fold lines 47 in a manner similar to central flaps 46A and, thereafter, the separable flap segments 49 of the flaps 46B are foldable inwardly toward one another along their fold lines 50 to the angled position in a manner similar to the separable flap segments 49 of the flaps 46A. In the angled position, the attached flap segments 48 of the central flaps 46B are co-planar or substantially co-planar with the respective attached flap segments 48 of the central flaps 46A which have been folded upwardly from the base panel 120. When the separable flap segments 49 of the central flaps 46B are folded to the angled position, the separable flap segments 49 of the flaps 46B are parallel or substantially parallel to the separable flap segments 49 of the flaps 46A which have been folded to the angled position. As described for flaps 46A, locking tabs 51 on the separable flap segments 49 of the central flaps 46B can be inserted into the aperture 43 located in base panel 120 between the attached flap segments 48 of flaps 46B. Overlapping ends of the separable flap segments 49 of the central support flaps 46B may be secured together via cooperative engagement of a securing element 52 on one separable flap segment with a securing element receptor 53 on the other separable flap segment as described for central flaps 46A.

The fold lines 47 for outer interior support flaps 46C are parallel or substantially parallel to the fold lines 47 for central flaps 46A. In the unfolded condition for outer interior support flaps 46C and central flaps 46A, the segment fold lines 50 of flaps 46C are aligned or substantially aligned longitudinally with the segment fold lines 50 of flaps 46A in the plane of blank 15. As shown in FIG. 5, the support flaps 46C are foldable upwardly or outwardly from the base panel 120 along their fold lines 47 in a manner similar to that described above for central flaps 46A, but with each flap 46C folding upwardly in a direction toward the adjacent central flap 46A. Accordingly, the flaps 46C are foldable upwardly or outwardly from the base panel 120 in a direction toward one another to assume a position where the flaps 46C are parallel or substantially parallel to the flaps 46A which have been folded upwardly from the base panel 120. As shown in FIG. 6, the separable flap segments 49 of the flaps 46C are thereafter foldable along their fold lines 50 relative to their attached flap segments 48 and base panel 120 to assume the angled position. When the separable flap segments 49 of the flaps 46C are folded to the angled position, the separable flap segments 49 of the flaps 46C are folded toward the corresponding side edge 122 of base panel 120. When the separable flap segments 49 of the flaps 46C are in the angled position, they are co-planar or substantially co-planar with the separable flap segments 49 of the central flaps 46A which have been folded to the angled position. The locking tabs 51 on the separable flap segments 49 of the flaps 46C can be inserted into respective apertures 43 located in base panel 120 between the attached flap segments 48 of flaps 46C and the side edges 122 to interlockingly secure the separable flap segments 49 of flaps 46C to the base panel 120 as explained above for flaps 46A. The apertures 43 that receive the locking tabs 51 of the flaps 46C are generally in line with the fold lines 50 of flaps 46C and can also receive the locking tabs 42 of the adjacent side wall flaps 132. The outer support flaps 46D are structurally and operationally similar to the support flaps 46*b* but with respect to the central flaps 46B. The outer side edges of the outer interior support flaps 46C and 46D may be provided with notches or recesses to accommodate the tuck flaps 129 thereon during foldable construction and assembly of the bottom member as described further below.

FIGS. 5-14 illustrate the steps involved in foldably constructing and assembling the top and bottom members 12 and 13 to obtain the force-resisting structure 10. It should be appreciated, however, that the sequence of steps involved in foldably constructing and assembling the top and bottom members 12 and 13 into the force-resisting structure 10 can vary from the sequence of steps described and illustrated herein.

FIG. 5 illustrates the bottom member 13 and its blank 15 initially folded from the unfolded condition, showing all of the interior support flaps 46A, 46B, 46C and 46D folded along their respective fold lines 47 upwardly or outwardly from the base panel 120 to an initial folded position perpendicular or substantially perpendicular to the base panel 120 as described above. In this initial folded position, the support flaps 46A and 46C are parallel or substantially parallel to one another, and the support flaps 46B and 46D are parallel or substantially parallel to one another. Each support flap 46A is co-planar or substantially co-planar with a corresponding support flap 46B, and each support flap 46C is co-planar or substantially co-planar with a corresponding support flap 46D.

FIG. 6 illustrates the bottom member 13 and its blank 15 with the support flaps 46A, 46B, 46C and 46D each folded to a subsequent folded position where the separable flap segments 49 of the support flaps are folded along the fold lines 50 relative to their attached flap segments 48 and relative to the base panel 120 to assume the angled position as explained above. In this position, each support flap has its separable flap segment 49 disposed at a right or substantially a right angle to its attached flap segment 48, with both the attached and separable flap segments 48 and 49 remaining perpendicular or substantially perpendicular to the base panel 120. The attached flap segments 48 of support flaps 46A and 46C remain parallel or substantially parallel to one another but the separable flap segments 49 of the support flaps 46A and 46C are now co-planar or substantially co-planar. The ends of the separable flap segments 49 of the support flaps 46A overlap one another and their locking tabs 51 are together received in the aperture 43 located for this purpose in the base panel 120 to interlock the separable flap segments of support flaps 46A with the base panel 120. In addition, the securing element 52 on the separable flap segment 49 of one support flap 46A is cooperatively engaged with the securing element receptor 53 on the separable flap segment 49 of the other support flap 46A, such as by punching the securing element 52 into or through the receptor 53, to interlock the support flaps 46A to one another. Together, the interlocked support flaps 46A form a vertical support structure having an angled C-shaped configuration.

The support flaps 46B are folded and interlocked in a manner similar to the support flaps 46A. The locking tabs 51 on the separable flap segments 49 of the support flaps 46B are received in the aperture 43 located for this purpose in base panel 120. The overlapping ends of the separable flap segments 49 of the support flaps 46B are secured by cooperative engagement of the securing element 52 on the separable flap segment 49 of one support flap 46B with the securing element receptor 53 on the separable flap segment 49 of the other support flap 46B. The interlocked support flaps 46B form a vertical support structure having an angled C-shaped configuration that is essentially a mirror image of the C-shaped configuration formed by the interlocked support flaps 46A.

The support flaps 46C have their locking tabs 51 received in the apertures 43 located for this purpose in base panel 120. The support flaps 46D similarly have their locking tabs 51 received in the apertures 43 located for this purpose in base panel 120. In the angled position, each support flap 46C forms a vertical support structure having an L-shaped configuration with the separable flap segments 49 thereof defining a leg of the L-shaped configuration extending toward the adjacent or corresponding side edge 122. Each support flap 46D similarly forms a vertical support structure having an L-shaped configuration that is essentially a mirror image of the corresponding support flap 46C. When the support flaps 46A, 46B, 46C and 46D are in the subsequent folded position depicted in FIG. 6, the outer side edges of the support flaps may now be considered upper edges of the support flaps since the support flaps are now oriented vertically relative to the base panel 120 which is oriented horizontally.

Figure 7:
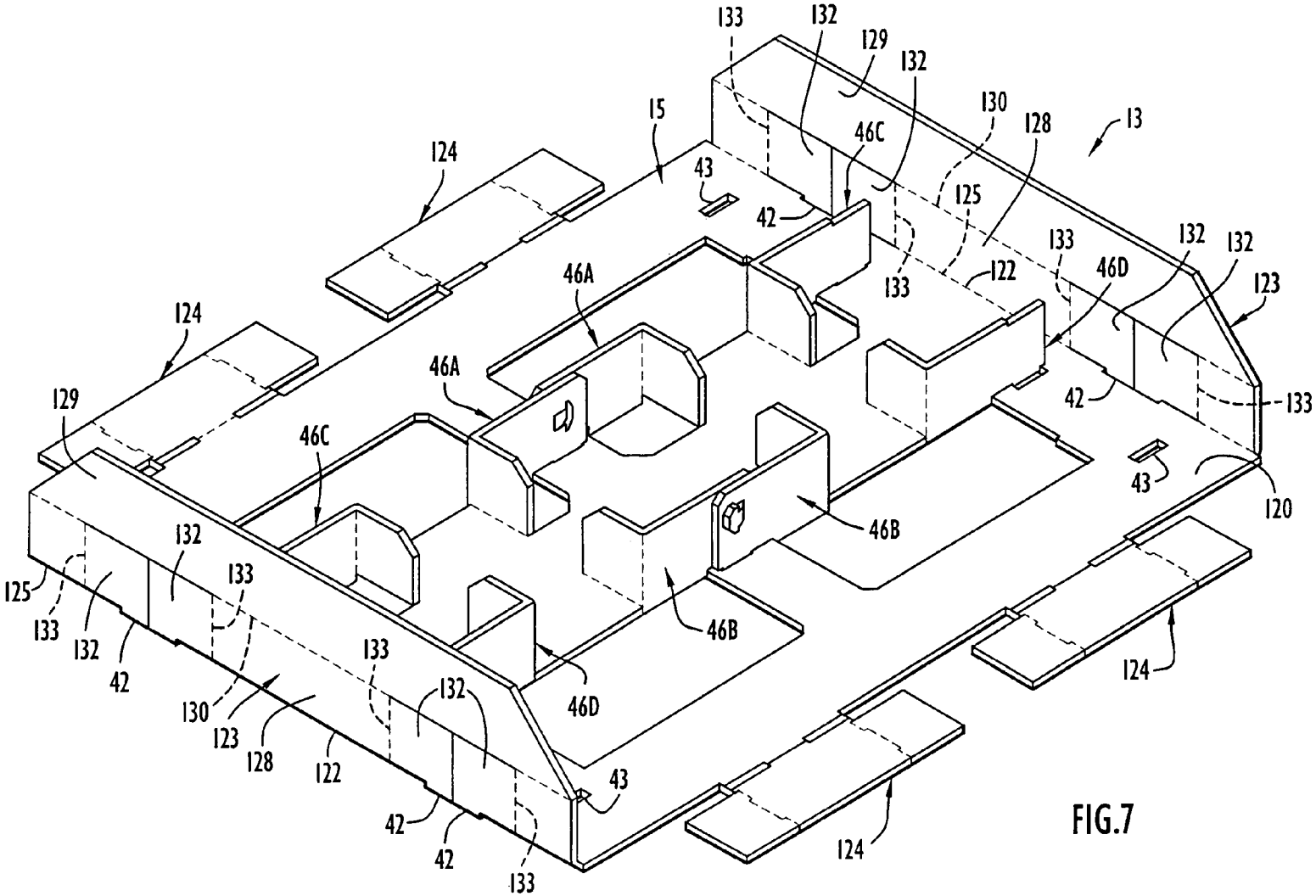
FIG. 7 is a perspective view of the bottom member showing opposed side portions of the bottom member folded relative to the base panel.

FIG. 7 illustrates the side portions 123 of the bottom member 13 and its blank 15 folded along their fold lines 125 outwardly or upwardly relative to base panel 120 to assume an initial folded position for the side portions 123 where each side portion 123 is perpendicular or substantially perpendicular to the base panel 120. In the initial folded position for the side portions 123, the side portions 123 are also parallel or substantially parallel to one another. Each side portion 123 remains flat or planar in the initial folded position, with the side wall 128 and the tuck flap 129 of each side portion 123 being co-planar or substantially co-planar.

Figure 8:
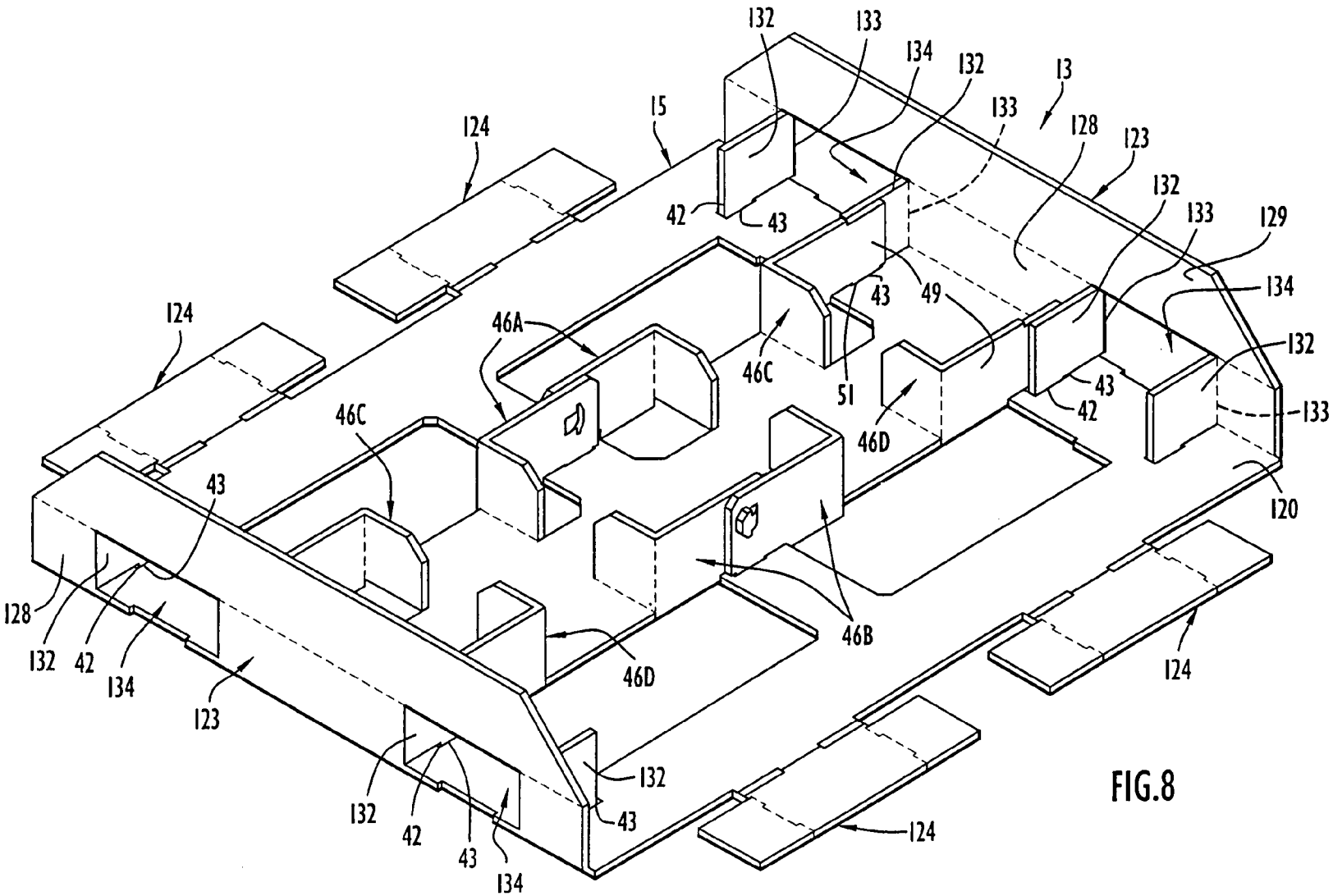
FIG. 8 is a perspective view of the bottom member showing side wall flaps of the bottom member folded relative to respective side walls of the opposed side portions to expose access openings in the side walls.

The bottom member 13 and its blank 15 are depicted in FIG. 8 with the side wall flaps 132 of each side wall 128 folded along their fold lines 133 relative to their side wall 128 and to base panel 120 to expose access openings 134 in the side walls 128. The side wall flaps 132 are folded inwardly toward what will eventually be the interior of the force-resisting structure 10. Each pair of side wall flaps 132 are folded in opposition or in a direction away from one another to expose the corresponding access opening 134. The side wall flaps 132 are disposed perpendicular or substantially perpendicular to the base panel 120 and are disposed at a right angle or substantially a right angle with the corresponding side wall 128. The side wall flaps 132 for each side wall 128 are parallel or substantially parallel to each other, and all of the side wall flaps 132 are perpendicular or substantially perpendicular to the attached flap segments 48 of interior support flaps 46A, 46B, 46C and 46D. The lower edges of the side wall flaps 132 rest on the base panel 120, and the locking tabs 42 on the side wall flaps 132 are received in the respective apertures 43 provided for this purpose in base panel 120. When the side wall flaps 132 are in their folded position as shown in FIG. 8, the outer side edges of the side wall flaps 132 may now be considered upper edges of the side wall flaps 132 and the inner side edges of the side wall flaps may now be considered lower edges of the side wall flaps since the side wall flaps 132 are now oriented vertically relative to the base panel 120. The ends of the separable flap segments 49 of support flaps 46C and 46D are respectively overlapped by a corresponding side wall flap 132, and the locking tabs 42 for these side wall flaps are received in the same apertures 43 that receive the locking tabs 51 of the separable flap segments 49 of support flaps 46C and 46D to interlockingly secure the side wall flaps 132 to base panel 120 so that these side wall flaps are in effect also interlockingly secured to the corresponding support flaps 46C and 46D. The upper edges of the side wall flaps 132 that overlap the separable flap segments 49 are aligned or substantially aligned with the upper edges formed by the notches in the respective separable flap segments to present an upper edge surface of greater thickness than either the side wall flap 132 or the separable flap segment 49 alone.

Figure 9:
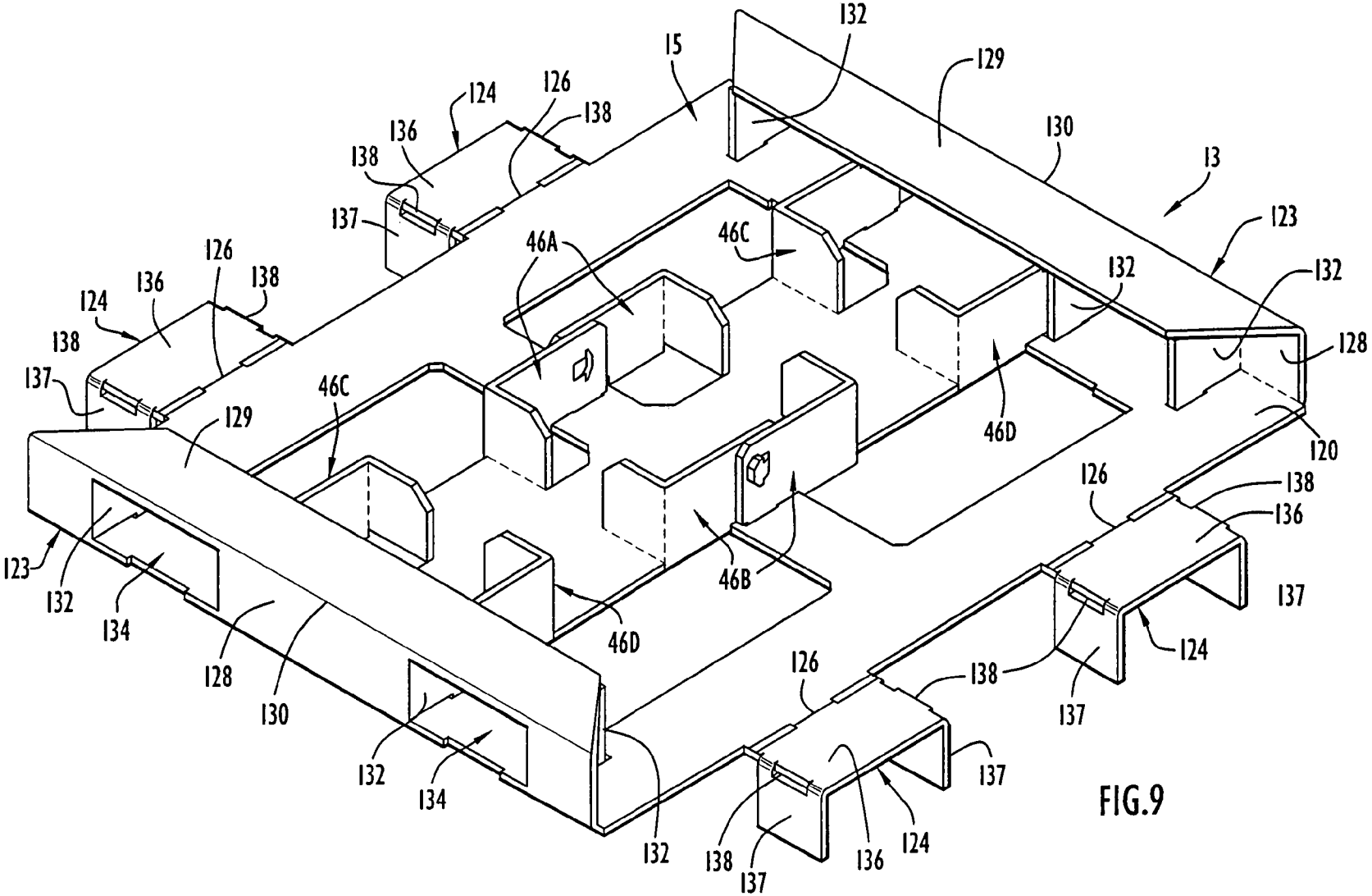
FIG. 9 is a perspective view of the bottom member showing tuck flaps of the opposed side portions folded relative to the respective side walls and also showing initial folding of opposed retention elements of the bottom member in which wings of each retention element are folded relative to a retention flap of the retention element.

FIG. 9 depicts folding of the side portions 123 to a subsequent folded position in which the tuck flaps 129 are folded along their corresponding fold lines 130 relative to their corresponding side walls 128 and in a direction toward the eventual interior of the force-resisting structure 10. The tuck flaps 129 are folded relative to the corresponding side walls 128 to a position where the tuck flaps 129 are perpendicular or substantially perpendicular to the side walls 128 and are parallel or substantially parallel to the base panel 120. In this position, the tuck flaps 129 are supported on the upper edges of the side wall flaps 132. In the bottom member 13, each tuck flap 129 is supported on the upper edges of four side wall flaps 132, two of which are additionally reinforced by virtue of their association with the separable flap segments 49 of interior support flaps 46C and 46D. The upper edge surfaces of greater thickness formed where the upper edges of the side wall flaps 132 are aligned or substantially aligned with the upper edges formed by the notches in the separable flap segments 49 of flaps 46C and 46D to provide greater support for the tuck flaps 129 thereon. Accordingly, the tuck flaps 129 are also supported on the flaps 46C and 46D.

FIG. 9 also depicts the retention elements 124 of the bottom member 13 and its blank 15 folded to an initial folded position where the wings 137 of each retention element 124 are folded along their fold lines 138 downwardly from their retention flaps 136. The wings 137 are folded from their corresponding retention flap 136 in a direction opposite the initial direction of folding of the side portions 123 from the base panel 120. In the initial folded position for the retention elements 124, the wings 137 of each retention element 124 are parallel or substantially parallel to one another and are perpendicular or substantially perpendicular to the corresponding retention flap 136. Also, each retention element 124 presents a perimeter along its retention flap 136 to fit within the perimeter of access openings 34 in the side walls 28 of top member 12.

Figure 10:
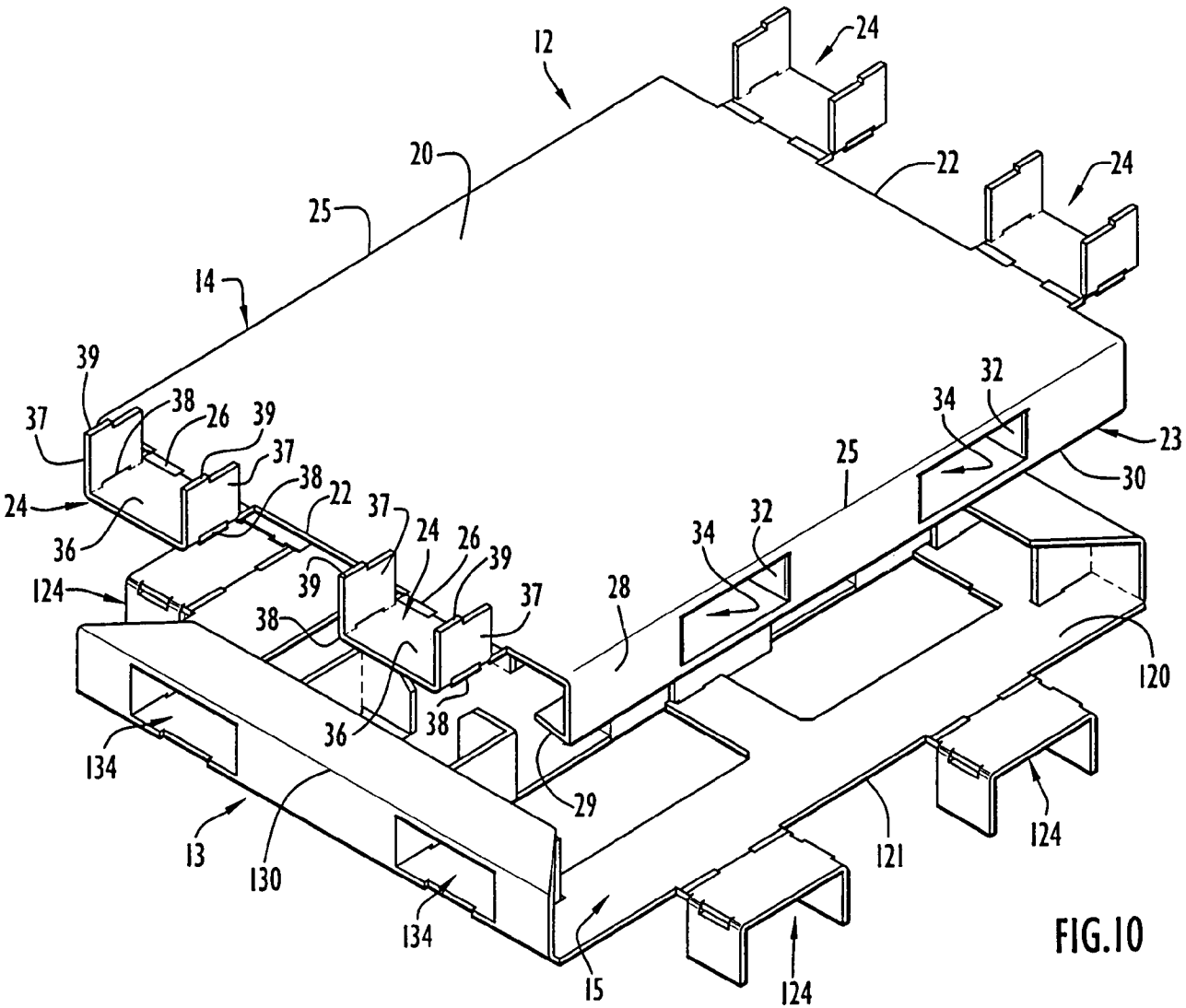
FIG. 10 is a perspective view illustrating the top member positioned over the bottom member and showing opposed side portions of the top member folded relative to a base panel of the top member, showing side wall flaps of the top member folded relative to respective side walls of the opposed side portions of the top member to expose access openings in the side walls of the top member located in correspondence with the retention elements of the bottom member, showing tuck flaps of the opposed side portions of the top member folded relative to the respective side walls of the top member, and showing initial folding of opposed retention elements of the top member located in correspondence with the access openings of the bottom member and in which wings of each retention element of the top member are folded relative to a retention flap of the retention element of the top member.

FIG. 10 illustrates the bottom member 13 and its blank 15 folded as previously described and depicts the top member 12 and its blank 14 disposed over the bottom member 13 after being folded in a manner similar to that previously described for the bottom member 13. In particular, FIG. 10 illustrates the top member 12 and its blank 14 with the side portions 23 folded in a manner similar to side portions 123 except that the side portions 23 are initially folded along fold lines 25 in a downward direction relative to base panel 20. The access openings 34 are exposed in the side walls 28 of top member 12 by folding the side wall flaps 32 relative to the side walls 28 as described for the access openings 134. The access openings 34 exposed in the side walls 28 of top member 12 are located in correspondence with the retention elements 124 of the bottom member 13. The tuck flaps 29 of the top member 12 are folded inwardly from side walls 28 toward what will be the interior of the force-resisting structure 10, and the side wall flaps 32 are disposed between the base panel 20 and the tuck flaps 29. The inner side edges of the side wall flaps 32 may now be considered upper edges of the side wall flaps 32 and the outer side edges of the side wall flaps 32 may be considered lower edges of the side wall flaps 32 since the side wall flaps 32 are now oriented vertically with respect to the base panel 20. The base panel 20 is supported on the upper edges of the side wall flaps 32, and the lower edges of the side wall flaps 32 rest on the tuck flaps 29. The retention elements 24 are initially folded in the same manner as previously described for retention elements 124 except that the wings 37 of retention elements 24 are folded along their fold lines 38 in an upward direction opposite the direction of folding for the wings 137 of retention elements 124. The retention elements 24 of the top member 12 are located in correspondence with the access openings 134 in the bottom member 13.

Figure 11:
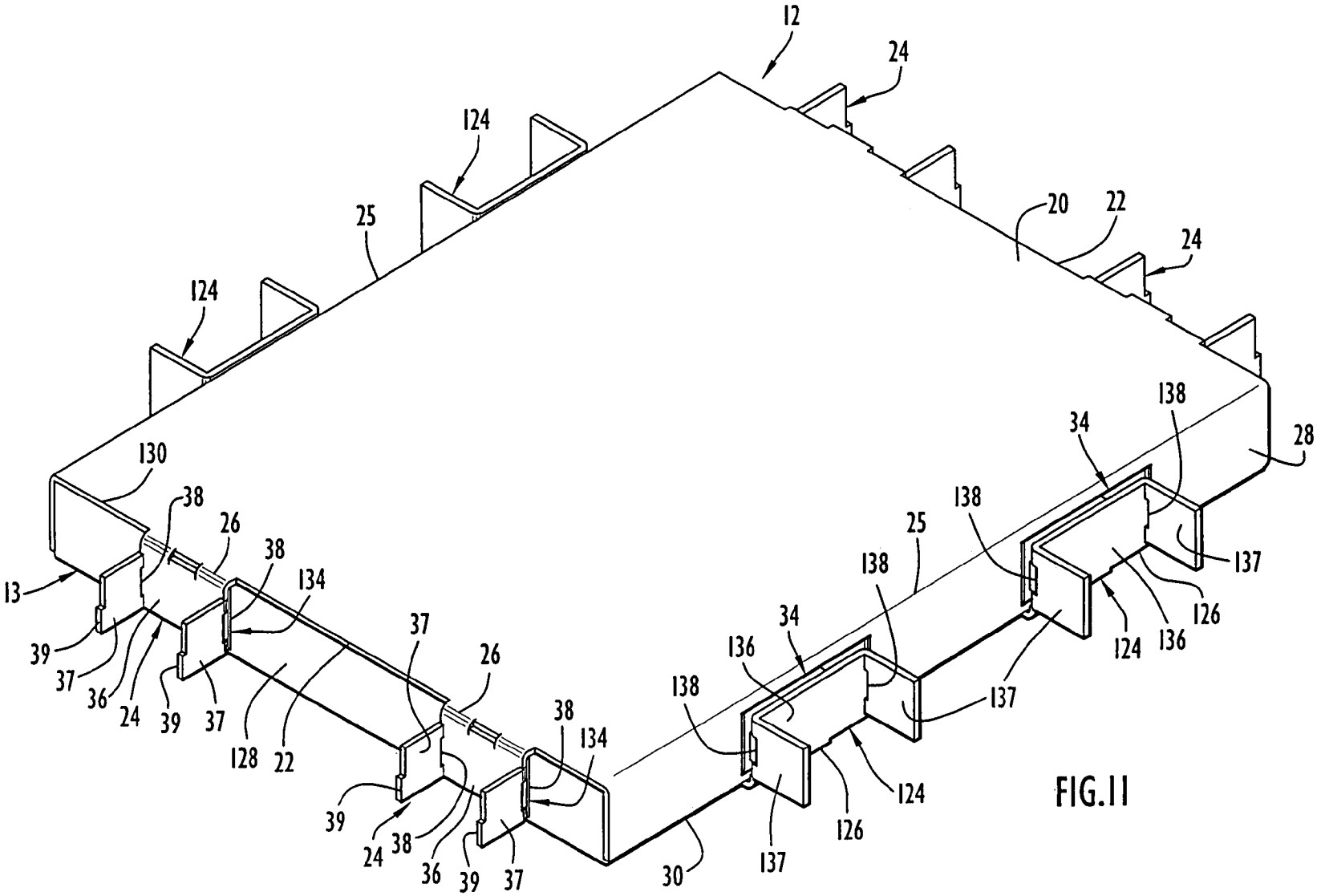
FIG. 11 is a perspective view of the top and bottom members depicting the retention flaps of the retention elements of the bottom member folded into alignment with the access openings of the top member and depicting the retention flaps of the retention elements of the top member folded into alignment with the access openings of the bottom member.

FIG. 11 depicts the top member 12 assembled over or on top of the bottom member 13 in nested relation. The tuck flap fold lines 30 of the top member 12 are positioned adjacent the first side edges 121 of the bottom member 13, and the second side edges 22 of the top member 12 are positioned adjacent the tuck flap fold lines 130 of bottom member 13. The tuck flaps 29 of top member 12 are disposed on the base panel 120 and are confined between the base panel 120 and the lower edges of side wall flaps 32. The base panel 20 is disposed on the tuck flaps 129, which are confined between the base panel 20 and the upper edges of side wall flaps 132. The base panels 20 and 120 are parallel or substantially parallel to one another and the side walls 28 and 128 are perpendicular or substantially perpendicular to the base panels 20, 120. The base panel 20 rests or is supported on the upper edges of the interior support flaps 46A, 46B, 46C and 46D, which fit snugly between the base panels 20 and 120. The side walls 28, 128 cooperate to form a peripheral side wall along the perimeter of the base panels 20, 120.

The blank 15 may be cut from the sheet material 16 so that the lines of corrugation run parallel to side edges 121. Consequently, the lines of corrugation for the interior support flaps 46A, 46B, 46C and 46D will run vertical and perpendicular or substantially perpendicular to the horizontal base panel 120 when the support flaps are folded upwardly from the base panel 120. In this manner, loads on the base panel 20 are supported by the support flaps along the lines of corrugation for increased load support strength.

FIG. 11 also shows the retention elements 24 and 124 folded to a subsequent folded position in which the retention flaps 36, 136 are folded along their fold lines 26, 126 to a position perpendicular or substantially perpendicular to the base panels 20, 120 such that the retention flaps 36,136 align with the correspondingly located access openings 34, 134. In particular, the retention flaps 36 of the retention elements 24 are folded along their fold lines 26 in a downward direction from base panel 20 to align with the correspondingly located access openings 134 in the side walls 128 of bottom member 13. The retention elements 124 are folded along their fold lines 126 upwardly from the base panel 120 to align with the correspondingly located access openings 34 in the side walls 28 of top member 12. The perimeter presented by each retention element 24, 124 along its retention flap 36, 136 is slightly smaller than the perimeter of the aligned access opening 34, 134 and can fit within the aligned access opening.

Figure 12:
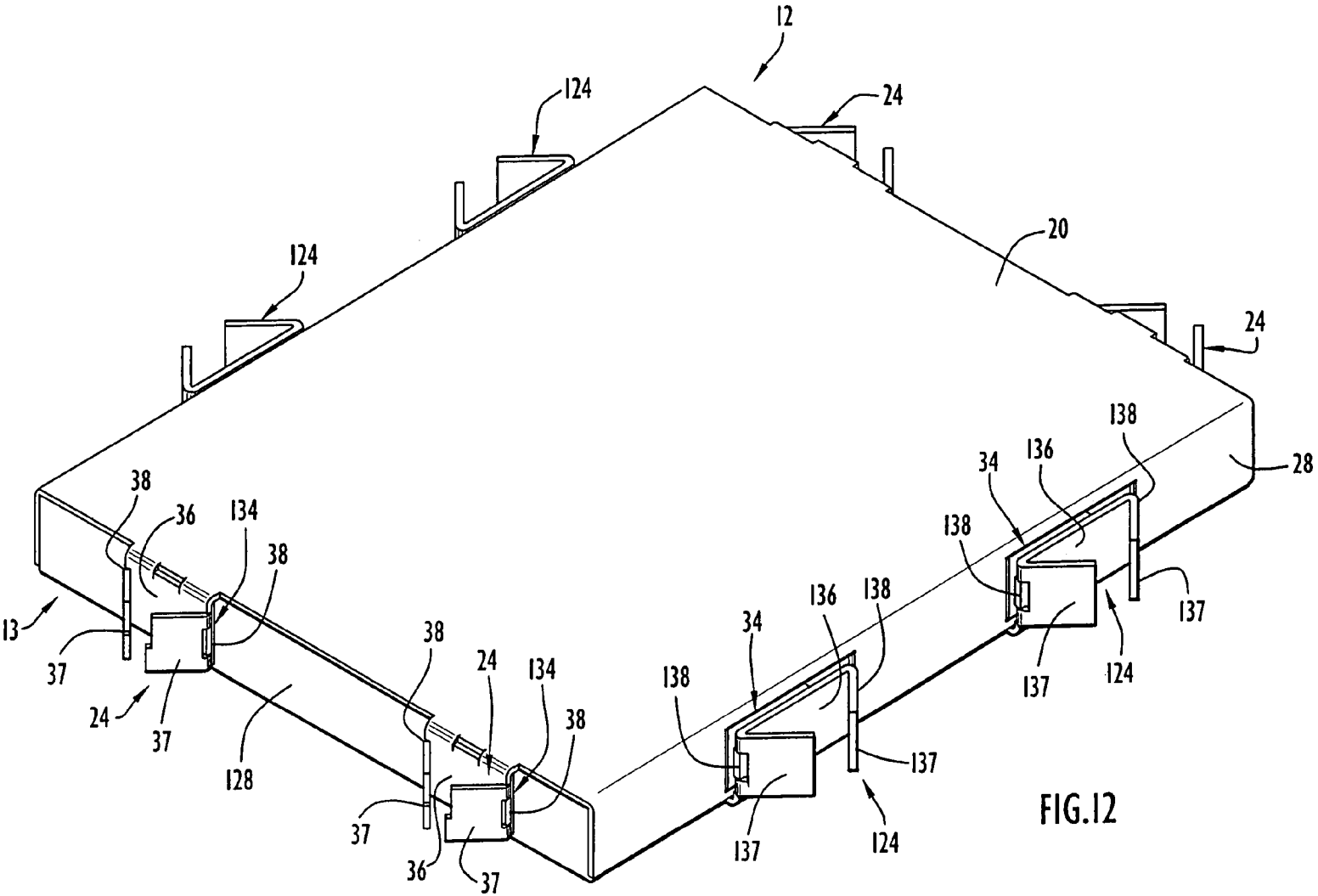
FIG. 12 is a perspective view of the top and bottom members showing the wings of each retention element folded toward their corresponding retention flaps.

A subsequent folded position for the retention elements 24, 124 is shown in FIG. 12 wherein the wings 37, 137 of the retention elements 24, 124 are folded along their fold lines 38, 138 inwardly toward their corresponding retention flaps 36, 136 to define an acute angle with their corresponding retention flaps. This subsequent folded position for the retention elements 24, 124 may be considered a collapsed position in which the retention elements are able to be folded into the correspondingly located access openings 34, 134.

Figure 13:
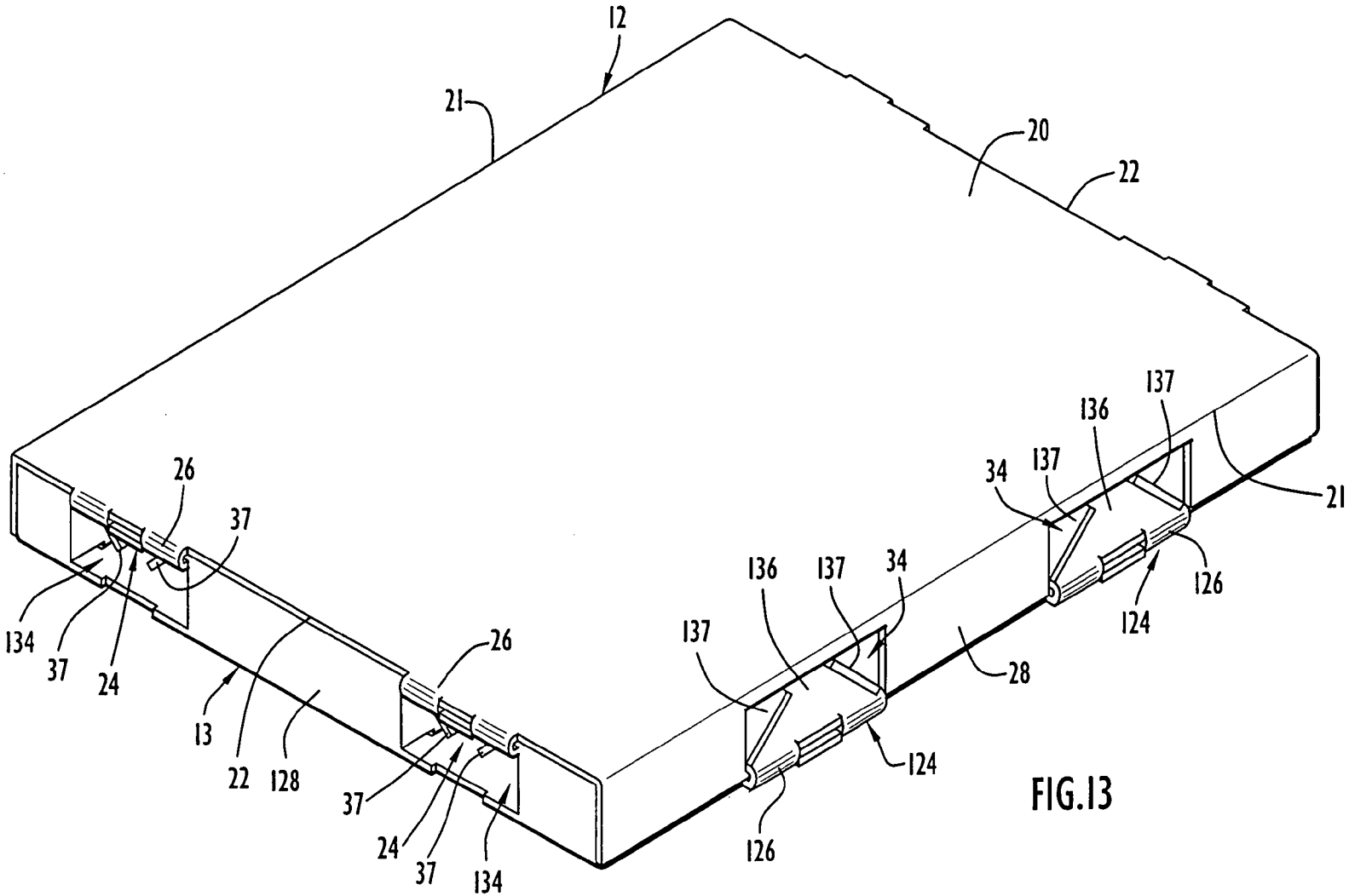
FIG. 13 is a perspective view of the top and bottom members illustrating the retention elements of the top member folded into the aligned access openings of the bottom member and illustrating the retention elements of the bottom member folded into the aligned access openings of the top member.
Figure 14:
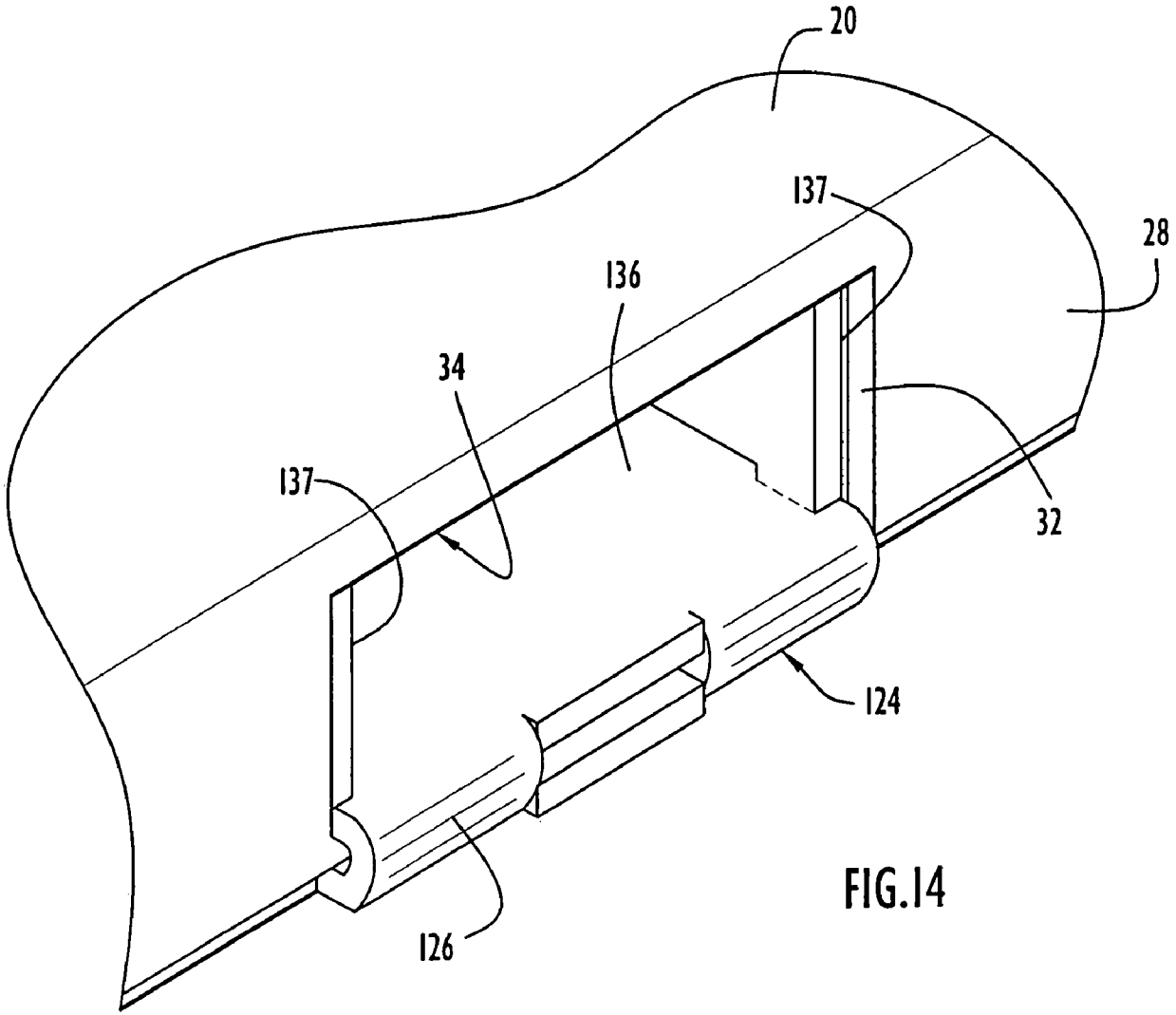
FIG. 14 is a broken perspective view depicting the wings of a retention element of the bottom member folded relative to the retention flap of the retention element to assume a position at least substantially perpendicular to the base panels of the top and bottom members.

Final folding of the retention elements 24, 124 to interlockingly secure the top and bottom members 12 and 13 in nested relation and complete foldable construction and assembly of the force-resisting structure 10 is depicted in FIGS. 13 and 14. As shown in FIG. 13, the retention elements 24, 124 are folded along their fold lines 26, 126 relative to their base panels 20, 120 toward the interior of the force-resisting structure 10 causing the retention elements 24, 124 to pass into the correspondingly located access openings 34, 134 and into the interior of the force-resisting structure, as permitted by the collapsed position of the retention elements. The retention elements 24 are folded along their fold lines 26 such that the retention flaps 36 are in abutment with the tuck flaps 129. The retention elements 124 are folded along their fold lines 126 such that the retention flaps 136 are in abutment with the tuck flaps 29. Thereafter, the wings 37, 137 of the retention elements 24, 124 are unfolded from their collapsed position and are returned to a position perpendicular or substantially perpendicular to the retention flaps 36,136 as illustrated in FIG. 1 and as depicted in greater detail in FIG. 14, which shows one of the retention elements 124. As shown in FIG. 14, the wings 137 of the retention elements 124 are unfolded from the collapsed position by unfolding the wings 137 along their respective fold lines 138 in opposition to one another in an upward direction. The end edges of the wings 137 may now be considered upper edges of the wings 137 since the wings 137 extend vertically upwardly from the retention flaps 136, which are disposed over tuck flaps 29. The wings 37 of each retention element 24 are unfolded in a similar manner but are unfolded along their fold lines 38 in opposition to one another in a downward direction. Furthermore, the locking tabs 39 on the wings 37 are received in the apertures 43 provided in base panel 120 along the side edges 122 to interlockingly secure the wings 37 to the base panel 120. The locking tabs 39 for the innermost wings 37 are received in the same apertures 43 that receive the locking tabs 51 of the support flaps 46C and 46D. The innermost wings 37 are thusly in effect interlockingly secured to the interior support flaps 46C and 46D as well as to the side wall flaps 132 that have their locking tabs 42 received in the same aperture as the locking tabs of the support flaps 46C and 46D. The end edges of wings 37 may now be considered lower edges of the wings 37 since the wings 37 extend vertically downwardly from their retention flaps 36, which are disposed beneath tuck flaps 129. Accordingly, the tuck flaps 29 are snugly held between the retention flaps 136 and the base panel 120 with the base panel 20 being supported on the upper edges of wings 137. The tuck flaps 129 are snugly held between the base panel 20 and the retention flaps 36 with the lower edges of the wings 37 being supported on the base panel 120. The retention flaps 36, 136 are parallel or substantially parallel to the base panels 20, 120, and the wings 37, 137 are perpendicular or substantially perpendicular to the base panels 20, 120. The side wall flaps 32, 132 also fit snugly between the base panels 20, 120 with the tuck flaps 29, 129 snugly interposed between the side wall flaps and the base panels 20, 120. The interior support flaps 46A, 46B, 46C and 46D fit snugly between the base panels 20, 120. The top member base panel 20 defines an elevated top surface of the force-resisting structure 10 for supporting a load thereon. The access openings 34, 134 in the side walls 28, 128 provide communication with the interior of the force-resisting structure 10 for the insertion of a lifting mechanism, such as a pallet jack or fork of lifting equipment such as a forklift. The access openings 34, 134 are situated to accommodate the lifting mechanisms of various lifting equipment, allowing the force-resisting structure 10, with a load supported thereon, to be lifted and moved from place to place.

Figure 15:
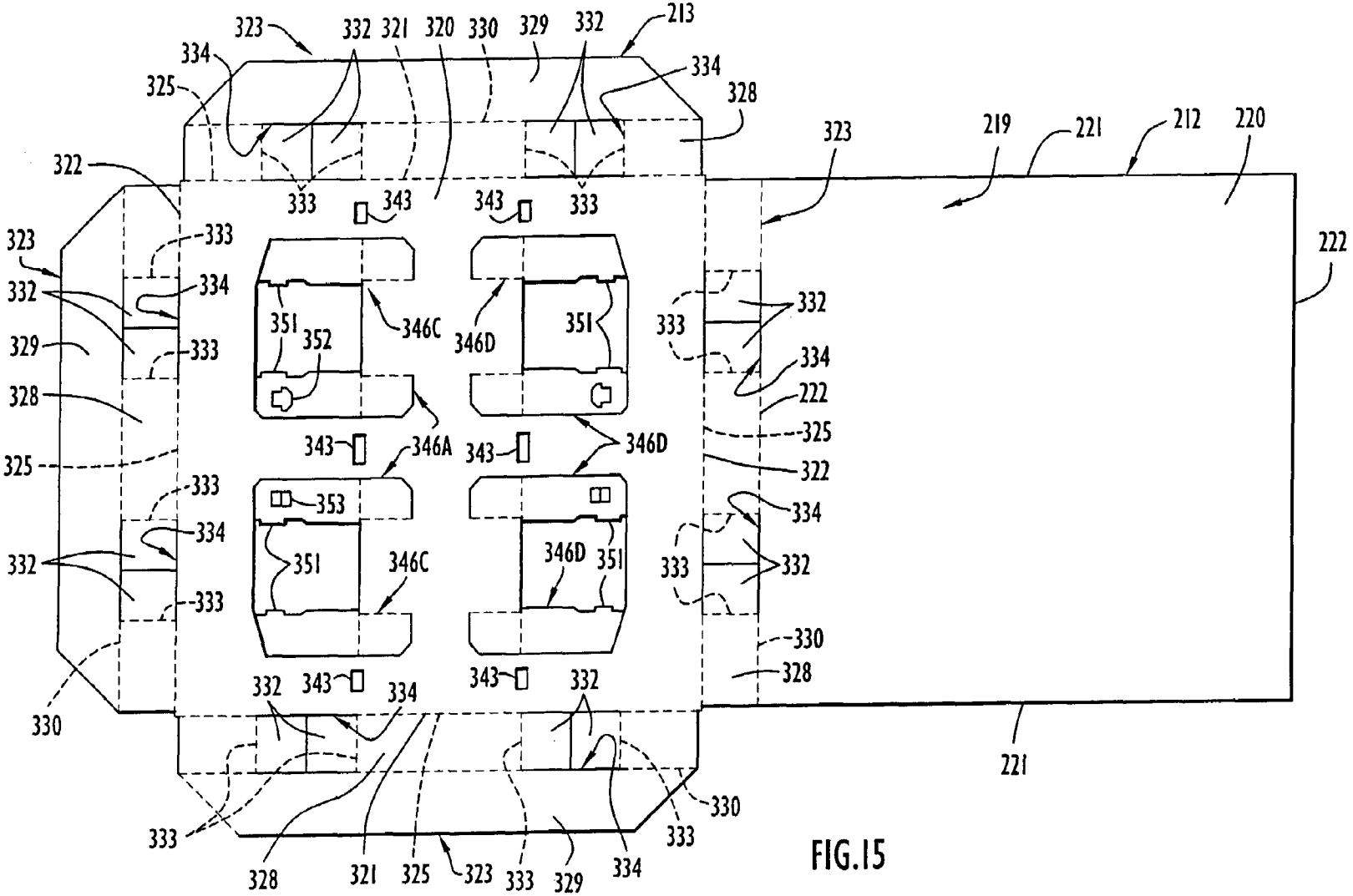
FIG. 15 is a plan view of an alternative top member and bottom member formed together as one piece prior to being foldably constructed into an alternative foldably constructed force-resisting structure according to the present invention.
Figure 16:
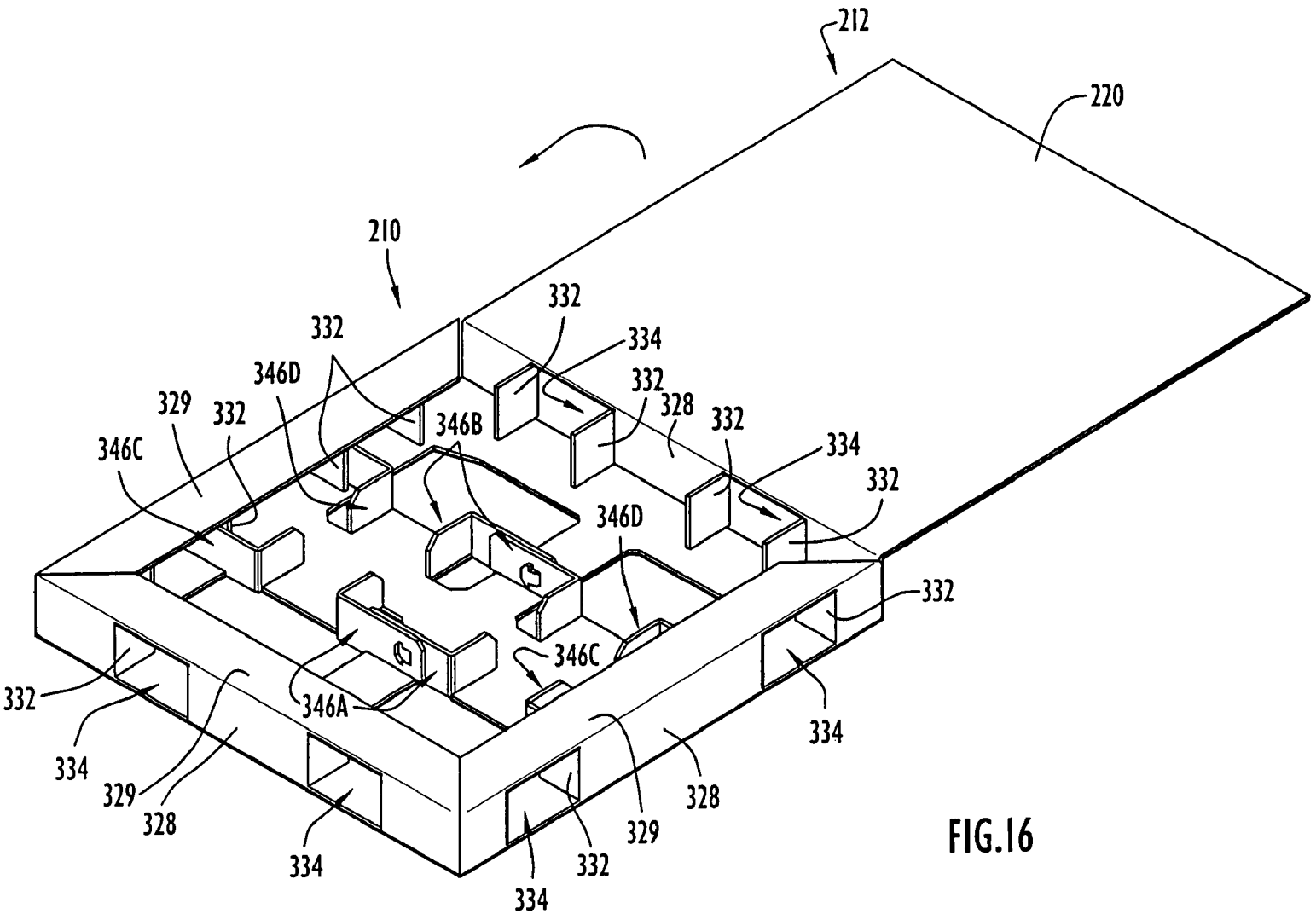
FIG. 16 is a perspective view of the top and bottom members of FIG. 15 partially foldably constructed into the alternative foldably constructed force-resisting structure.

An alternative first or top member 212 and an alternative second or bottom member 213 are depicted in FIG. 15 prior to being foldably constructed or assembled into an alternative foldably constructed force-resisting structure 210 illustrated in FIG. 16. The top member 212 and the bottom member 213 are formed together as an integral and unitary or monolithic one-piece blank 219 that is flat or planar in its unfolded condition shown in FIG. 15. The top member 212 comprises a top member base panel 220 having first side edges 221 and second side edges 222. The bottom member 213 comprises bottom member base panel 320 having first side edges 321 and second side edges 322 in correspondence with the first and second side edges of top member 212. Side portions 323 are foldably connected to the side edges 321 and 322 of base panel 320 along respective inner side wall fold lines 325. The side portions 323 that are foldably connected to both side edges 321 and to one of the side edges 322 are similar to the side portions 23 and 123. These side portions 323 comprise a side wall 328 foldably connected to the side edge of base panel 320 along the corresponding fold line 325 and a tuck flap 329 foldably connected to the side wall 328 along a tuck flap fold line 330. The side portion 323 that is foldably connected to the remaining side edge 322 is provided without a tuck flap and has its side wall 328 foldably connected to the side edge of the bottom member base panel 320 along the inner side wall fold line 325 and to a side edge 222 of the top member base panel 220 along the outer side wall fold line 330. Each of the side walls 328 has side wall flaps 332 foldable relative to the side wall 328 along side wall flap fold lines 333 to expose an access opening 334 as described above for force-resisting structure 10. The base panel 320 is provided with a plurality of interior support flaps including central interior support flaps 346A and 346B and outer interior support flaps 346C and 346D similar to those already described for bottom member 13.

The top and bottom members 212 and 213 and their blank 219 are foldably constructed or assembled into the force-resisting structure 210 in a manner similar to that described above for force-resisting structure 10. The interior support flaps 346A, 346B, 346C and 346D are folded along their respective support flap fold lines upwardly from the base panel 320 to the initial folded position perpendicular or substantially perpendicular to the base panel 320. The support flaps 346A, 346B, 346C and 346D are thereafter folded to the angled position where the separable flap segments thereof are angled from the attached flap segments. The locking tabs 351 on the separable flap segments are received in the apertures 343 provided in the base panel 320 for this purpose. The overlapping ends of the separable flap segments of support flaps 346A and 346B are secured via retention of the securing elements 352 in the securing element receptors 353. The support flaps 346A, 346B, 346C and 346D form a vertical support structure for the top member base panel 220. The side portions 323 are folded along their fold lines 325 upwardly from the base panel 320 to assume the initial folded position where side walls 328 are perpendicular or substantially perpendicular to the base panel 320. The side wall flaps 332 are folded along their fold lines 333 to expose the access openings 334. The tuck flaps 329 are folded inwardly along the tuck flap fold lines 330 to rest on the upper edges of the side wall flaps 332. The base panel 220 is then folded inwardly along the outer side wall fold line 330 that connects it to side wall 328 as shown by the arrow in FIG. 16. The base panel 220 will rest on top of the tuck flaps 329 and the side wall flaps 332, and can be secured to the bottom member 213 in any suitable manner including adhesive such as glue or tape and/or mechanical fasteners such as staples or clips. Preferably, the base panel 220 is fastened to the tuck flaps 329 via the appropriate fasteners. The side wall flaps 332 fit snugly within the interior of the force-resisting structure 210 and provide vertical support for the base panel 220 along the perimeter of the force-resisting structure 210. The interior support flaps 46A, 46B, 46C and 46D provide vertical support for the base panel 220 as described above for the force-resisting structure 10.

Figure 17:
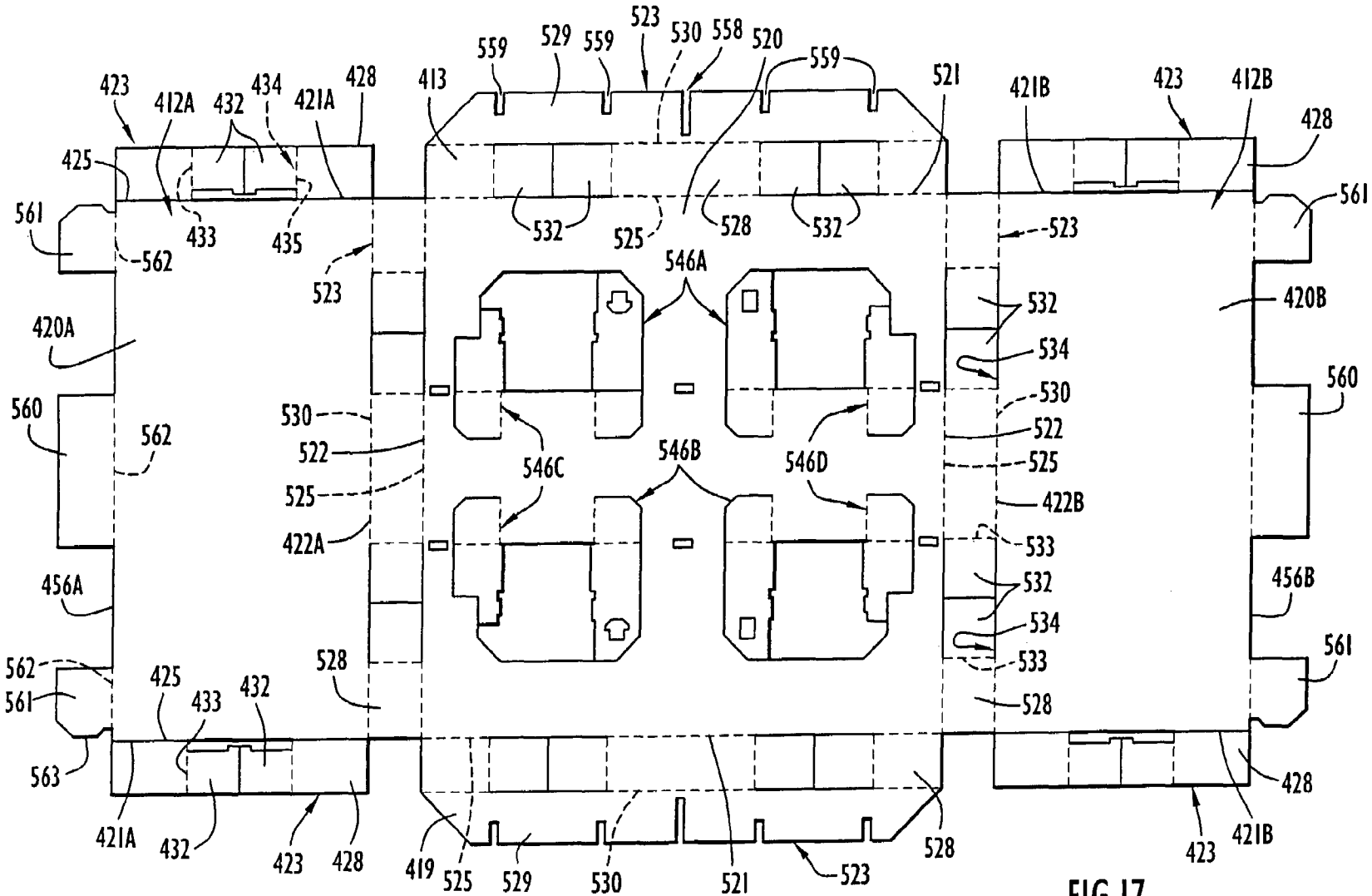
FIG. 17 is a plan view of a further alternative top member and bottom member formed together as one piece prior to being foldably constructed into a further alternative foldably constructed force-resisting structure according to the present invention.
Figure 19:
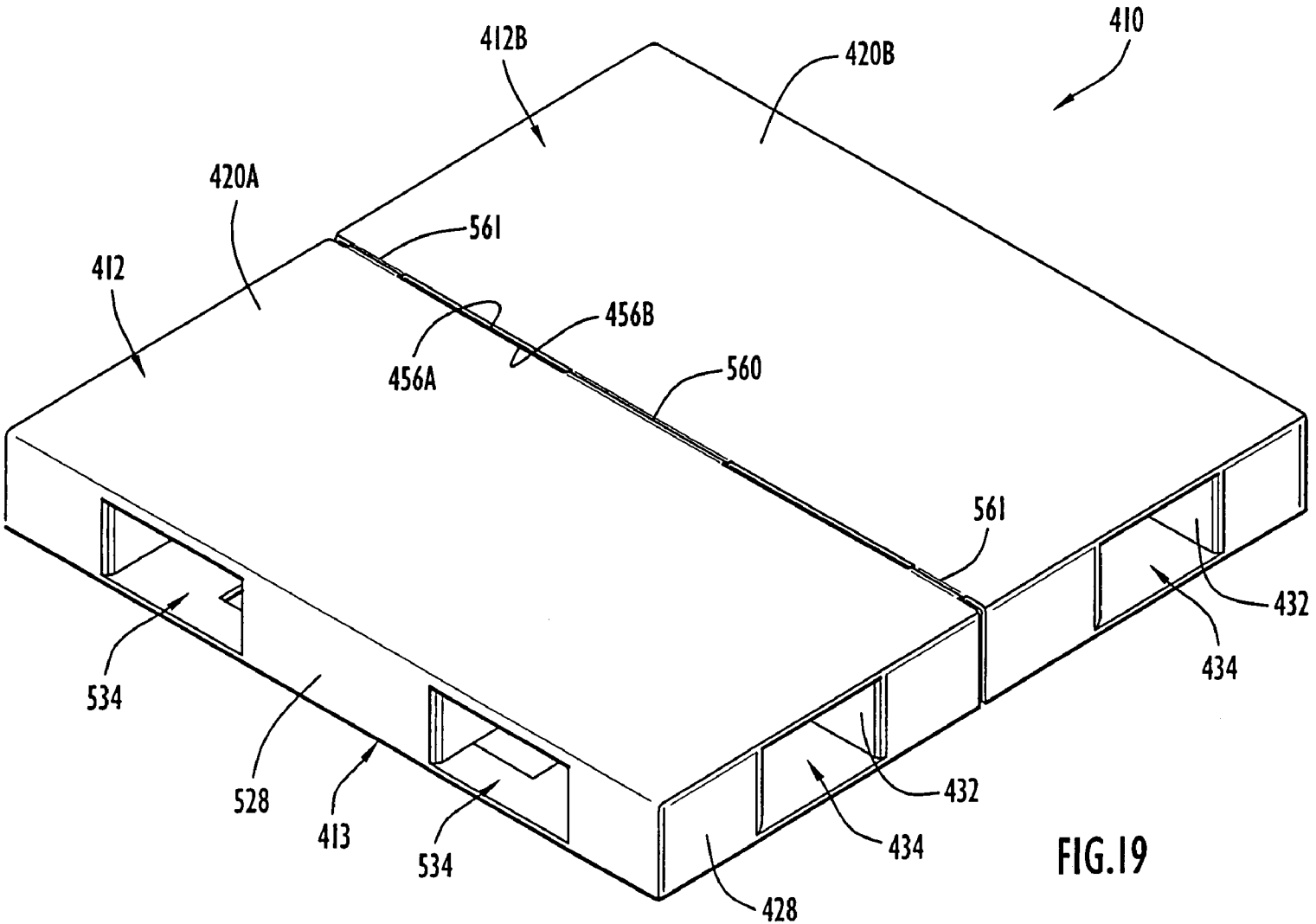
FIG. 19 is a perspective view illustrating the top and bottom members of FIG. 17 finally foldably constructed into the further alternative foldably constructed force-resisting structure.

A further alternative top member and bottom member are depicted in FIG. 17 prior to being foldably constructed or assembled into a further alternative force-resisting structure 410, which is depicted in FIG. 19 in a partially foldably constructed condition. The top and bottom members depicted in FIG. 17 are similar to the top and bottom members 212 and 213 except that the top member depicted in FIG. 17 comprises first and second top member portions 412A and 412B, each foldably connected to a side wall 528 that is foldably connected to the base panel 520 of bottom member 413. The top member, i.e. top member portions 412A, 412B, and the bottom member 413 depicted in FIG. 17 are formed together integrally and unitarily or monolithically as a one-piece blank 419 initially in an unfolded condition. The bottom member 413 is similar to the bottom member 213 and comprises bottom member base panel 520 having a first pair of opposed side edges 521 and a second pair of opposed side edges 522. Side portions 523 are foldably connected to the base panel 520 at side portion or inner side wall fold lines 525 along the side edges 521, and these side portions 523 include a side wall 528 foldably connected to the base panel 520 at the fold line 525 and a tuck flap 529 foldably connected to the side wall 528 at the tuck flap fold line 530. The tuck flaps 529 differ from the tuck flaps 329 in that each tuck flap 529 has a central slot 558 between two pairs of outer slots 559, the slots 558 and 559 extending from an outer side edge of the tuck flap 529 in a direction perpendicular to the fold lines 525 and 530. Both side portions 523 that are foldably connected to the base panel 520 along side edges 522 are provided without tuck flaps and comprise side walls 528 foldably connected to the base panel 520 at the inner side wall fold lines 525 along the side edges 522 and foldably connected to the side edges 422A and 422B of the top member portion 412A and 412B, respectively, along the outer side wall fold lines 530. Each side wall 528 has side wall flaps 532 foldable along respective fold lines 533 to expose the access openings 534.

Top member portion 412A comprises a first top member base panel portion 420A having opposed first side edges 421A in correspondence with the first side edges 521 of bottom member 413 and about one half the length of side edges 521, a side edge 422A in correspondence with the side edge 522 of bottom member 413 to which the portion 420A is connected by side wall 528, and a terminal side edge 456A extending between the side edges 421A in parallel with the side edge 422A. The side edge 422A comprises the fold line 530 that connects the top member base panel portion 412A to the side wall 528 of the bottom member. The top member portion 412B is essentially a mirror image of the top member portion 412A and comprises a second top member base panel portion 420B having opposed side edges 421B in correspondence with the side edges 521 of bottom member 413 and about one half the length of the side edges 521, a side edge 422B foldably connected to the opposite side edge 522 of the bottom member via the side wall 328, and a terminal side edge 456B. Each top member portion 412A and 412B comprises side portions 423 foldably connected to its side edges 421A and 421 B at side wall fold lines 425 along the side edges 421A and 421B. Each side portion 423 includes a side wall 428 foldably connected to the top member portion at the corresponding fold line 425 and side wall flaps 432 foldably connected to the side wall 428 for folding relative to the side wall to expose an access opening 434 in the side wall 428. Each terminal side edge 456A and 456B has a central insertion flap 560 and two outer insertion flaps 561 foldably connected thereto at respective insertion flap fold lines 562, the central insertion flap 560 being located between the two outer insertion flaps 561. Outer ends of the outer insertion flaps 561 are configured with protuberances 563. The bottom member base panel 520 is provided with a vertical support structure comprising central interior support flaps 546A and 546B and outer interior support flaps 546C and 546D similar to the central and outer support flaps previously described.

Figure 18:
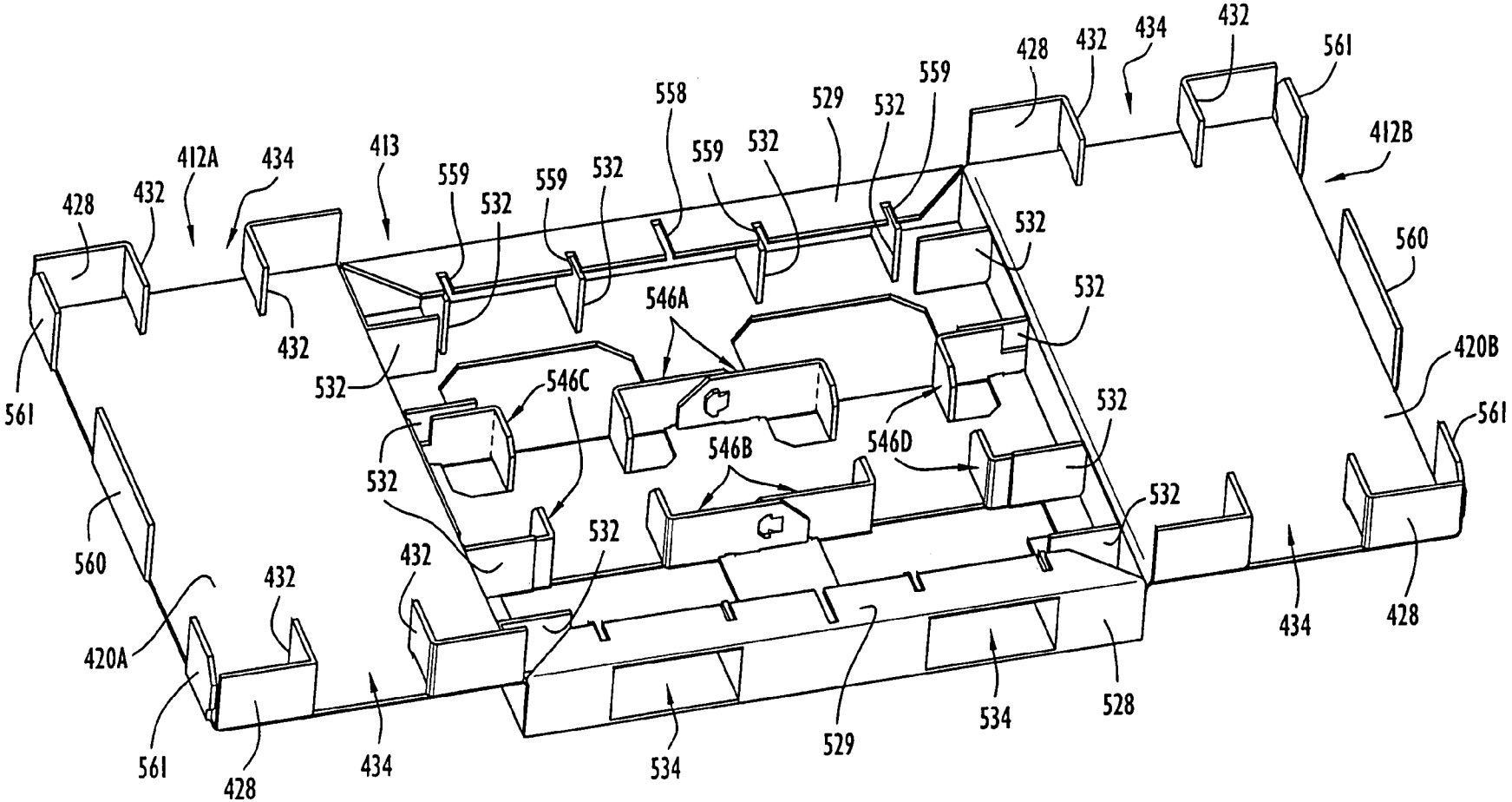
FIG. 18 is a perspective view depicting the top and bottom members of FIG. 17 partially foldably constructed into the further alternative foldably constructed force-resisting structure.

FIG. 18 illustrates the top member 412A, 412B and the bottom member 413 partially foldably constructed or assembled into the force-resisting structure 410. The blank 419 forming top member 412A, 412B and bottom member 413 is foldably constructed or assembled in a manner similar to that previously described for force-resisting structures 10 and 210. The interior support flaps 546A, 546B, 546C and 546D are folded along their respective support flap fold lines upwardly from the base panel 520 to the initial folded position perpendicular or substantially perpendicular to the base panel 520. Thereafter, the separable flap segments of the support flaps 46A, 46B, 46C and 46D are folded relative to their attached flap segments to assume the angled position as shown in FIG. 18. The separable flap segments of the support flaps 546A, 546B, 546C and 546D are interlocked with the base panel 520 by inserting the locking tabs on the separable flap segments into the corresponding apertures provided for this purpose in the base panel 520. The separable flap segments of the central support flaps 546A and 546B are secured together in overlapping relation by inserting the locking element on one separable flap segment into the locking element receptor on the other separable flap segment. The side portions 523 are folded along their fold lines 525 upwardly from the base panel 520 to assume the initial folded position where the side walls 528 are perpendicular or substantially perpendicular to the base panel 520. The side wall flaps 532 are folded inwardly relative to their side walls 528 to expose the access openings 534, and the tuck flaps 529 are folded inwardly relative to their side walls 528 to a position parallel or substantially parallel to base panel 520. The outer slots 559 in the tuck flaps 529 are aligned with the side wall flaps 532, which are perpendicular or substantially perpendicular to their side walls 528.

The side portions 423 of the top member portions 412A and 412B are folded relative to their base panel portions 420A and 420B along their fold lines 425 so that the side walls 428 are perpendicular or substantially perpendicular to the base panel portions 420A and 420B in the same direction as side walls 528 as seen in FIG. 18. The central insertion flaps 560 and the outer insertion flaps 561 are folded along their fold lines 562 relative to the base panel portions 420A and 420B in the same direction as the side walls 428 to assume a position perpendicular or substantially perpendicular to the base panel portions 420A and 420B. The side wall flaps 432 in the side walls 428 are folded along their fold lines 433 inwardly to expose the access openings 434 in the side walls 428. Foldable construction of the force-resisting structure 410 is completed by folding the top member portions 412A and 412B inwardly toward one another along their fold lines 530 and interlockingly securing the top member portions 412A and 412B to the bottom member 413. Interlocking securement involves inserting the side wall flaps 432 of the top member portions 412A and 412B into the corresponding access openings 534 in the bottom member, with the side walls 428 overlapping the corresponding side walls 528. The terminal side edges 456A and 456B are brought adjacent one another, the central insertion flaps 560 are inserted between the terminal side edges and are confined between the C-shaped structures formed by the support flaps 546A and 546B, and the outer insertion flaps 561 are inserted between the terminal side edges and into the central slots 558. The protuberances 563 on the outer ends of the outer insertion flaps 561 resist withdrawal of the outer insertion flaps from the slots 558. The top member base panel portions 420A and 420B are supported by the side wall flaps 532 and by the interior support flaps 546A, 546B, 546C and 546D. The top member base panel portions 420A and 420B complete and define an elevated top surface of the force-resisting structure 410 parallel or substantially parallel to the bottom member base panel 520. The top member 412A, 412B is interlockingly secured to the bottom member 413. Vertical support is provided for the top member base panel portions 420A and 420B by the side wall flaps 432 and 532, by the interior support flaps 546A, 546B, 546C and 546D, and by the insertion flaps 560 and 561, all of which extend perpendicularly or substantially perpendicularly between the top and bottom member base panels.

Figure 20:
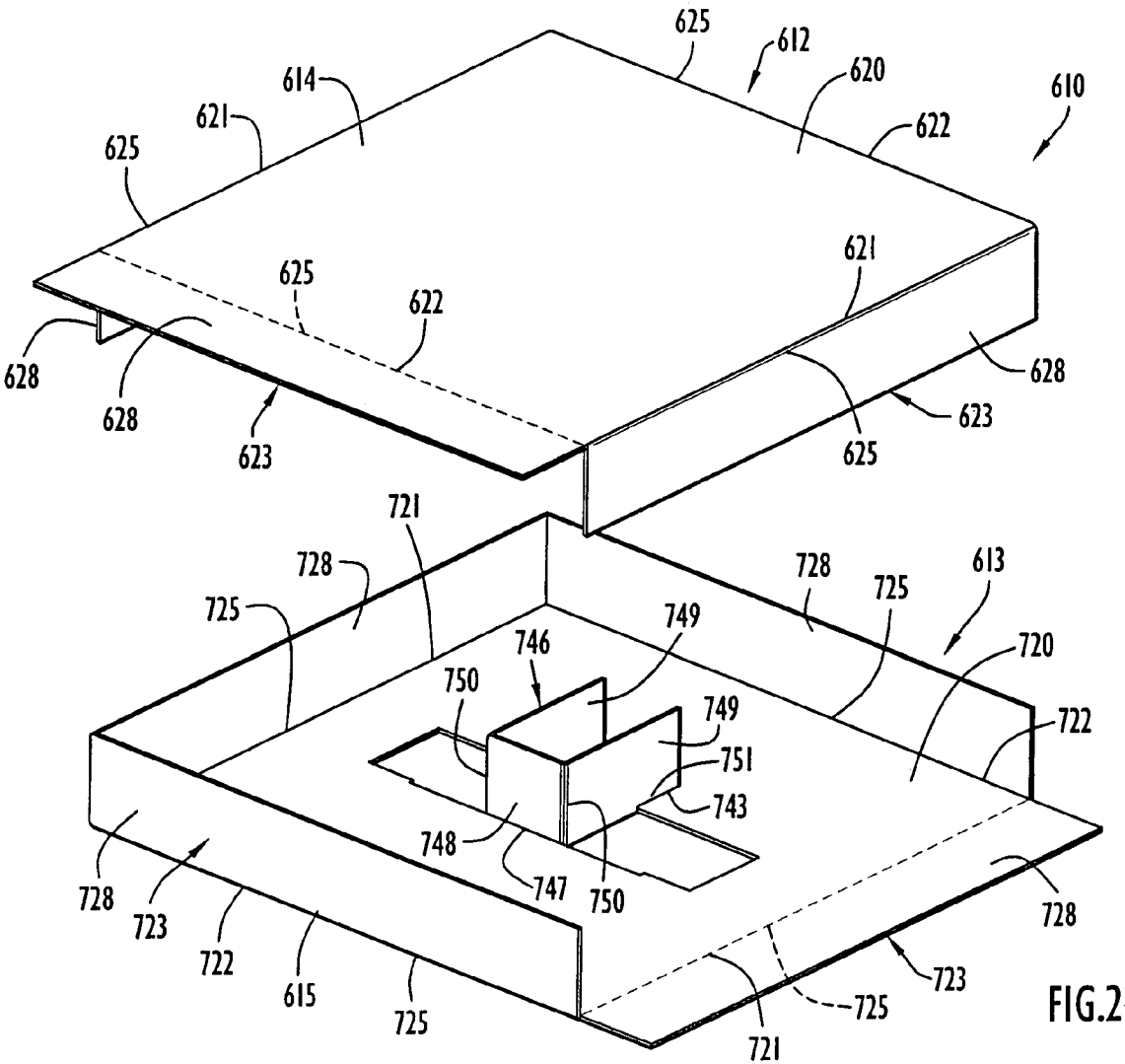
FIG. 20 is a perspective view of another alternative top member and bottom member partially foldably constructed into another alternative force-resisting structure according to the present invention.

Another alternative force-resisting structure 610 is illustrated in FIG. 20 in a partially foldably constructed condition and comprises a top member 612 formed from a one-piece blank 614 and a bottom member 613 formed from a one-piece blank 615. The top member 612 includes a base panel 620 having opposed side edges 621 and opposed side edges 622. A side portion 623 made up of a side wall 628 is foldably connected to each of the edges 621 and 622 along a side wall fold line 625. The bottom member 613 comprises a base panel 720 having opposed side edges 721 in correspondence with the side edges 621 of the top member and opposed side edges 722 in correspondence with the side edges 622 of the top member. A side portion 723 made up of a side wall 728 is foldably connected to each of the side edges 721 and 722 at a side wall fold line 725. The perimeter of base panel 720 is slightly smaller than the perimeter of base panel 620 to allow the top member 612 to fit over the bottom member 613 in nested relation. The bottom member 613 includes a single interior support flap 746 foldable upwardly from the base panel 720 along a support flap fold line 747 connected to the bottom member base panel 720. The support flap 746 comprises an attached flap segment 748 foldably connected to the base panel 720 along the fold line 747 and two separable flap segments 749 foldably connected to opposite ends of the attached flap segment 748 along fold lines 750 perpendicular to the fold line 747. The separable flap segments 749 are foldable along their fold lines 750 relative to the attached flap segment 748 and base panel 720. The blanks 614 and 615 of the top and bottom members are initially in an unfolded condition wherein the blanks are flat or planar.

In order to foldably construct or assemble the top and bottom members 612 and 613 into the force-resisting structure 610, the side walls 628 of the top member 612 are folded downwardly from base panel 620 along their fold lines 625 so that the side walls 628 are perpendicular or substantially perpendicular to the base panel 620 as shown in FIG. 20, which shows one side wall 628 not yet folded downwardly from the base panel 620. When the side walls 628 are folded downwardly from the base panel 620 to be disposed perpendicular or substantially perpendicular to the base panel 620, the end edges of adjacent side walls meet one another and form corners, such that the side walls 628 cooperate to form a peripheral side wall around the perimeter of the base panel 620. The side walls 728 of bottom member 613 are folded along their fold lines 725 in a manner similar to side walls 628 but are folded upwardly from the base panel 720 as shown in FIG. 20, which shows one side wall 728 not yet folded upwardly from base panel 720. When the side walls 728 are disposed perpendicular or substantially perpendicular to the base panel 720, their adjacent end edges meet at corners and the side walls 728 cooperate to form a peripheral side wall around the perimeter of base panel 720. The interior support flap 746 is folded upwardly from the base panel 720 to be disposed perpendicular or substantially perpendicular to the base panel 720 and parallel or substantially parallel to an opposed pair of the side walls 728. Thereafter, the separable flap segments 749 are independently folded along their fold lines 750 relative to the attached flap segment 748 and relative to the base panel 720 so that the separable flap segments 749 are disposed at an angle to the attached flap segment 748 while remaining perpendicular or substantially perpendicular to the base panel 720. The separable flap segments 749 are shown defining a right angle or substantially a right angle with the attached flap segment 748 and as being parallel or substantially parallel to one another to form a vertical support structure of U-shaped configuration. In bottom member 613, the support flap 746 is oriented so that the attached flap segment 748 is parallel to the side edges 722 and the separable flap segments 749 are parallel to the side edges 721 when the support flap 746 is in the angled position. Locking tabs 751 on the separable flap segments 749 are received in corresponding apertures 743 in the bottom member base panel 720. The top member 612 is then disposed over the bottom member 613 in nested relation, the bottom member 613 being received within the top member 612 with a snug fit. Conversely, the top member 612 can be sized to be received within the bottom member 613 in nested relation with a snug fit. The top member base panel 620 is supported on the upper edges of the support flap 746 and defines an elevated top surface of the force-resisting structure 610.

In the force-resisting structures, the top and bottom members can be interlocked in nested, assembled relation due to the interlocking relationship between portions of the top and bottom members themselves, without the need for extraneous fasteners. Structural strength, rigidity and integrity, including increased torsional strength and load support strength, are enhanced in the force-resisting structures because the portions of the top and bottom members that interlock, that secure or are secured to other portions, and/or that provide vertical support for the top member base panel are formed out of the initial blanks of sheet material and remain integral with the blanks. Structural strength, rigidity and integrity, including torsional strength and load support strength, are also enhanced in the force-resisting structures due to the snug fit of the wings, the side wall flaps and/or the vertical support structures in the interior of the force-resisting structures. The force-resisting structures can be designed to support loads along the lines of corrugation of the sheet material for greater strength, rigidity and integrity, including greater torsional strength and load support strength. The side wall flaps and/or the wings can be arranged to provide vertical support entirely around the perimeter of the force-resisting structures to resist deflection of the top member base panels when subjected to force from a load thereon. The interior support flaps can form vertical support structures of various configurations. The central interior support flaps provide vertical support for the top member base panels toward the center of the force-resisting structures, and the outer interior support flaps provide vertical support for the top member base panels toward the sides of the force-resisting structures. The top and bottom members can be easily manufactured and can be shipped and/or stored in the unfolded condition in which the top and bottom members occupy minimal space due to their flat or planar configuration. The force-resisting structures can be disassembled or broken down for return to the unfolded condition subsequent to use. The force-resisting structures are readily and easily recyclable or disposable. Accordingly, the force-resisting structures minimize adverse environmental impact, occupy minimal space prior to and/or subsequent to assembly, and effectively save in production, storage and transportation costs. The force-resisting structures are especially well suited for use as a pallet or as a dunnage support.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A foldably constructed force-resisting structure comprising a top member formed from a single blank of sheet material initially in a flat condition prior to folding, said top member comprising a top member base panel having a perimeter defined by a plurality of side edges, a top member side portion foldably connected to one of said side edges at a side portion fold line and a top member retention element foldably connected to another of said side edges at a retention element fold line, said top member side portion including a side wall foldably connected to said top member base panel at said side portion fold line, a tuck flap foldably connected to said side wall at a tuck flap fold line parallel to said side portion fold line, and an access opening in said side wall, said top member retention element comprising a retention flap foldably connected to said top member base panel at said retention element fold line and at least one wing foldably connected to said retention flap at a wing fold line perpendicular to said retention element fold line; and a bottom member formed from a single blank of sheet material initially in a flat condition prior to folding, said bottom member comprising a bottom member base panel having a perimeter defined by a plurality of side edges in respective correspondence with said side edges of said top member base panel, a bottom member side portion foldably connected to one of said side edges of said bottom member base panel in correspondence with said top member retention element, a bottom member retention element foldably connected to another of said side edges of said bottom member base panel in correspondence with said top member side portion, and at least one interior support flap foldably connected to said bottom member base panel at a support flap fold line, said bottom member side portion including a side wall foldably connected to said side edge of said bottom member base panel at a side portion fold line, a tuck flap foldably connected to said side wall of said bottom member side portion at a tuck flap fold line parallel to said side portion fold line of said bottom member side portion, and an access opening in said side wall of said bottom member side portion in correspondence with said top member retention element, said bottom member retention element comprising a retention flap in correspondence with said access opening of said top member side portion and foldably connected to said another side edge of said bottom member base panel at a retention element fold line and at least one wing foldably connected to said retention flap of said bottom member retention element at a wing fold line perpendicular to said retention element fold line of said bottom member retention element, said interior support flap comprising an attached flap segment foldably connected to said bottom member base panel at said support flap fold line and at least one separable flap segment foldably connected to said attached flap segment at a segment fold line perpendicular to said support flap fold line;

said side wall of said top member side portion being folded downwardly from said top member base panel along said side portion fold line of said top member side portion to a position at least substantially perpendicular to said top member base panel and said tuck flap of said top member side portion being folded inwardly from said side wall of said top member side portion along said tuck flap fold line of said top member side portion to a position at least substantially perpendicular to said side wall of said top member side portion and at least substantially parallel to said top member base panel, said side wall of said bottom member side portion being folded upwardly from said bottom member base panel along said side portion fold line of said bottom member side portion to a position at least substantially perpendicular to said bottom member base panel and said tuck flap of said bottom member side portion being folded inwardly from said side wall of said bottom member side portion along said tuck flap fold line of said bottom member side portion to a position at least substantially perpendicular to said side wall of said bottom member side portion and at least substantially parallel to said bottom member base panel, said wing of said top member retention element being folded relative to said retention flap of said top member retention element along said wing fold line of said top member retention element to allow said top member retention element to pass into said access opening of said bottom member side portion, said wing of said bottom member retention element being folded relative to said retention flap of said bottom member retention element along said wing fold line of said bottom member retention element to allow said bottom member retention element to pass into said access opening of said top member side portion, said interior support flap being folded upwardly from said bottom member base panel along said support flap fold line to a position at least substantially perpendicular to said bottom member base panel, said separable flap segment being folded along said segment fold line relative to said attached flap segment and said bottom member base panel to be disposed at an angle to said attached flap segment, said tuck flap of said top member side portion being disposed on said bottom member base panel, said top member base panel being disposed on said tuck flap of said bottom member side portion and being supported on said interior support flap with said top member base panel at least substantially parallel to said bottom member base panel, said top member retention element being folded into said access opening of said bottom member side portion to a position where said retention flap of said top member retention element is at least substantially parallel to said bottom member base panel and said wing of said top member retention element extends at least substantially perpendicularly between said base panels with a snug fit with said tuck flap of said bottom member side portion confined between said top member base panel and said retention flap of said top member retention element, said bottom member retention element being folded into said access opening of said top member side portion to a position where said retention flap of said bottom member retention element is at least substantially parallel to said top member base panel and said wing of said bottom member retention element extends at least substantially perpendicularly between said base panels with a snug fit with said tuck flap of said top member side portion confined between said bottom member base panel and said retention flap of said bottom member retention element.

2. The foldably constructed force-resisting structure recited in claim 1 wherein said perimeter of said top member base panel is defined by a pair of opposed first side edges and a pair of opposed second side edges, said top member includes opposed ones of said top member side portions foldably connected to said first side edges of said top member base panel, a plurality of access openings in each of said side walls of said top member side portions, and a plurality of said top member retention elements foldably connected to each of said second side edges of said top member base panel, said perimeter of said bottom member base panel is defined by a pair of opposed first side edges in correspondence with said first side edges of said top member base panel and a pair of opposed second side edges in correspondence with said second side edges of said top member base panel, said bottom member includes opposed ones of said bottom member side portions foldably connected to said second side edges of said bottom member base panel, a plurality of access openings in each of said side walls of said bottom member side portions in correspondence with said top member retention elements, and a plurality of bottom member retention elements foldably connected to each of said first side edges of said bottom member base panel in correspondence with said access openings of said top member side portions.

3. The foldably constructed force-resisting structure recited in claim 2 and further comprising a pair of side wall flaps associated with each of said access openings and foldably connected to said side walls at respective side wall flap fold lines, said side wall flaps being folded inwardly from said side walls to expose said access openings and to extend at least substantially perpendicularly between said base panels with a snug fit to provide vertical support for said top member base panel along said perimeter of said top member base panel.

4. The foldably constructed force-resisting structure recited in claim 3 wherein said side wall flaps of said bottom member side portion include locking formations engaged with locking formations in said bottom member base panel.

5. The foldably constructed force-resisting structure recited in claim 1 wherein each of said retention elements comprises two wings extending in opposite directions from said retention flap and foldably connected to said retention flap at respective wing fold lines.

6. The foldably constructed force-resisting structure recited in claim 1 wherein said at least one wing of said top member retention element includes a locking formation engaged with a locking formation in said bottom member base panel.

7. The foldably constructed force-resisting structure recited in claim 1 wherein said at least one separable flap segment includes a locking formation engaged with a locking formation in said bottom member base panel.

8. The foldably constructed force-resisting structure recited in claim 1 wherein said separable flap segment is disposed at substantially a right angle to said attached flap segment.

9. The foldably constructed force-resisting structure recited in claim 1 wherein said bottom member includes at least one pair of said interior support flaps, said interior support flaps being folded upwardly from said bottom member base panel and said separable flap segments of said interior support flaps being folded from said attached flap segments thereof to extend toward each other, said separable flap segments being secured to one another in interlocking relation.

10. The foldably constructed force-resisting structure recited in claim 1 wherein said sheet material is corrugated paperboard.

11. A foldably constructed force-resisting structure comprising a top member and a bottom member formed together from a single blank of sheet material initially in a flat condition prior to folding, said bottom member comprising a bottom member base panel having a perimeter defined by a plurality of side edges, a first side wall foldably connected to one of said side edges at a side wall fold line, at least one side portion foldably connected to at least another of said side edges, and at least one interior support flap foldably connected to said bottom member base panel at a support flap fold line, said side portion including a second side wall foldably connected to said another of said side edges at a side portion fold line and a tuck flap foldably connected to said second side wall at a tuck flap fold line parallel to said side portion fold line, said interior support flap comprising an attached flap segment foldably connected to said bottom member base panel at said support flap fold line and a separable flap segment foldably connected to said attached flap segment at a segment fold line perpendicular to said support flap fold line, said top member comprising a top member base panel having a perimeter defined by a plurality of side edges in correspondence with said side edges of said bottom member base panel, one of said side edges of said top member base panel being foldably connected to said first side wall at an outer side wall fold line parallel to said side wall fold line, said first side wall being folded along said side wall fold line upwardly from said bottom member base panel to a position at least substantially perpendicular to said bottom member base panel, said second side wall being folded along said side portion fold line upwardly from said bottom member base panel to a position at least substantially perpendicular to said bottom member base panel, said tuck flap being folded inwardly from said second side wall along said tuck flap fold line to a position at least substantially parallel to said bottom member base panel, said top member base panel being folded inwardly from said first side wall along said outer side wall fold line to be disposed over said tuck flap at least substantially in parallel with said bottom member base panel, said interior support flap being folded upwardly from said bottom member base panel along said support flap fold line to a position at least substantially perpendicular to said bottom member base panel, said separable flap segment being folded along said segment fold line relative to said attached flap segment and said bottom member base panel to be disposed at an angle to said attached flap segment, said top member base panel being supported on said interior support flap and being fastened to said bottom member.

12. The foldably constructed force-resisting structure recited in claim 11 and further comprising an access opening in at least one of said side walls.

13. The foldably constructed force-resisting structure recited in claim 12 and further comprising a side wall flap foldably connected to said at least one of said side walls along a side wall flap fold line, said side wall flap being folded inwardly from said at least one of said side walls to expose said access opening and to extend at least substantially perpendicularly between said base panels with a snug fit.

14. The foldably constructed force-resisting structure recited in claim 13 wherein said perimeter of said bottom member base panel is defined by a pair of opposed first side edges and a pair of opposed second side edges, said first side wall is foldably connected to said bottom member base panel along one of said second side edges, said bottom member further comprises a plurality of said side portions respectively foldably connected to said first side edges and to said opposed second side edge, at least one of said access openings in each of said side walls of said plurality of said side portions, and a pair of said side wall flaps foldably connected to each of said side walls of said plurality of said side portions, said side walls of said plurality of said side portions being folded upwardly from said bottom member base panel along said side portion fold lines thereof to a position at least substantially perpendicular to said bottom member base panel, said tuck flaps of said plurality of said side portions being folded inwardly from said side walls of said plurality of said side portions along said tuck flap fold lines thereof to a position at least substantially parallel to said bottom member base panel, said side wall flaps being folded inwardly from said side walls of said plurality of said side portions to expose said access openings and to extend at least substantially perpendicularly between said base panels, said tuck flaps being supported on said side wall flaps, said top member base panel being disposed over said tuck flaps with said tuck flaps confined between said top member base panel and said side wall flaps, and said top member base panel being fastened to said tuck flaps.

15. The foldably constructed force-resisting structure recited in claim 11 wherein said sheet material is corrugated paperboard.

16. A foldably constructed forced-resisting structure comprising a top member and a bottom member formed together from a single blank of sheet material initially in a flat condition prior to folding, said bottom member comprising a bottom member base panel having a perimeter defined by a pair of opposed first side edges and a pair of opposed second side edges, a pair of side walls foldably connected to said second side edges at respective inner side wall fold lines, and at least one interior support flap foldably connected to said bottom member base panel along a support flap fold line, said at least one interior support flap comprising an attached flap segment foldably connected to said bottom member base panel along said support flap fold line and a separable flap segment foldably connected to said attached flap segment at a segment fold line perpendicular to said support flap fold line, said top member comprising a top member base panel including a first top member base panel portion and a second top member base panel portion, said first top member base panel portion having a perimeter defined by a pair of opposed first side edges in correspondence with said first side edges of said bottom member base panel, a second side edge foldably connected to one of said side walls of said bottom member at an outer side wall fold line, and a terminal side edge opposite said second side edge of said first top member base panel portion, said top member comprising at least one insertion flap foldably connected to said first top member base panel portion at an insertion flap fold line along said terminal side edge, said second top member base panel portion having a perimeter defined by a pair of opposed first side edges in correspondence with said first side edges of said bottom member base panel, a second side edge foldably connected to the other of said side walls of said bottom member at an outer side wall fold line, and a terminal side edge opposite said second side edge of said second top member base panel portion, said top member further comprising at least one insertion flap foldably connected to said second top member base panel portion at an insertion flap fold line along said terminal side edge of said second top member base panel portion, said interior support flap being folded upwardly from said bottom member base panel along said support flap fold line to a position at least substantially perpendicular to said bottom member base panel, said separable flap segment being folded along said segment fold line relative to said attached flap segment and said bottom member base panel to be disposed at an angle to said attached flap segment, said side walls being folded upwardly from said bottom member base panel along said inner side wall fold lines to a position at least substantially perpendicular to said bottom member base panel, said first and second top member base panel portions being folded inwardly from said side walls along said outer side wall fold lines to a position at least substantially parallel to said bottom member base panel, said terminal side edges being disposed adjacent one another over said bottom member base panel such that said first and second top member base panel portions cooperate to form a top member base panel supported on said interior support flap at least substantially in parallel with said bottom member base panel, said insertion flaps being folded from said top member base panel portions along said insertion flap fold lines and being inserted between said terminal side edges to extend at least substantially perpendicularly between said top member base panel and said bottom member base panel.

17. The foldably constructed force-resisting structure recited in claim 16 wherein said top member comprises a central insertion flap between two outer insertion flaps foldably connected to said terminal edge of said first top member base panel portion, said top member further comprises a central insertion flap between two outer insertion flaps foldably connected to said terminal edge of said second top member base panel portion, said bottom member further comprises opposed side portions foldably connected to said first side edges of said bottom member base panel, each of said side portions comprises a side wall foldably connected to said bottom member base panel at a side portion fold line, a tuck flap foldably connected to said side wall at a tuck flap fold line, a slot in said tuck flap, an access opening in each of said side walls of said side portions, a pair of side wall flaps associated with each of said access openings and foldably connected to said side walls, said side walls being folded upwardly from said bottom member base panel to a position at least substantially perpendicular to said bottom member base panel, said side wall flaps being folded inwardly from said side walls of said side wall portions to expose said access openings and extend at least substantially perpendicularly to said bottom member base panel, said tuck flaps being folded inwardly from said side walls of said side portions along said tuck flap fold lines to a position at least substantially parallel to said bottom member base panel, said first and second top member base panel portions being disposed over said tuck flaps, said central insertion flaps being inserted between said terminal side edges to extend at least substantially perpendicularly between said top member base panel and said bottom member base panel, said outer insertion flaps being inserted between said terminal side edges and into said slots in said tuck flaps to extend at least substantially perpendicularly between said top member base panel and said bottom member base panel.

18. The foldably constructed force-resisting structure as recited in claim 17 wherein said first top member base panel portion further comprises opposed side walls foldably connected to said first side edges of said first top member base panel portions along side wall fold lines, and at least one side wall flap foldably connected to said side walls of said first top member base panel portion along a side wall flap fold line to expose an access opening in said side walls of said first top member base panel portion, said second top member base panel portion further comprises opposed side walls foldably connected to said first side edges of said second top member base panel portion along side wall fold lines, and at least one side wall flap foldably connected to said side walls of said second top member base panel portion along a side wall flap fold line to expose an access opening in said side walls of said second top member base panel portion, said side walls of said top member base panel portions being folded from said top member base panel portions along said side wall fold lines to a position at least substantially perpendicular to said top member base panel portions, said side wall flaps of said top member base panel portions being folded inwardly from said side walls of said top member base panel portions to a position at least substantially perpendicular to said side walls of said top member base panel portions, said side walls of said top member base panel portions being disposed over said side walls of said bottom member, and said side wall flaps of said top member base panel portions being folded into said access openings in said side walls of said bottom member in interlockingly relation.

19. The foldably constructed force-resisting structure as recited in claim 18 wherein said tuck flaps include slots respectively aligned over said side wall flaps of said bottom member.

20. The foldably constructed force-resisting structure as recited in claim 16 wherein said sheet material is corrugated paperboard.

21. A foldably constructed force-resisting structure comprising a top member formed from a single blank of sheet material initially in a flat condition prior to folding, said top member comprising a top member base panel having a perimeter defined by a plurality of side edges, and a plurality of side walls respectively foldably connected to said top member base panel at respective side wall fold lines along said plurality of side edges, said side walls being folded downwardly from said top member base panel along said side wall fold lines to a position where said side walls are disposed at least substantially perpendicularly to said top member base panel and define a peripheral side wall along said perimeter of said top member base panel; and a bottom member formed from a single blanks of sheet material initially in a flat condition prior to folding, said bottom member comprising a bottom member base panel having a perimeter defined by a plurality of side edges in respective correspondence with said side edges of said top member base panel, and a plurality of side walls respectively foldably connected to said bottom member base panel at respective side wall fold lines along said side edges of said bottom member base panel, and at least one interior support flap foldably connected to said bottom member base panel at a support flap fold line, said interior support flap comprising an attached flap segment foldably connected to said bottom member base panel at said support flap fold line and two separable flap segments foldably connected to said attached flap segment at respective segment fold lines perpendicular to said support flap fold line, said interior support flap being folded upwardly from said bottom member base panel along said support flap fold line to a position at least substantially perpendicular to said bottom member base panel, said separable flap segments being folded along said respective segment fold lines relative to said attached flap segment and said bottom member base panel to be disposed at an angle to said attached flap segment, said side walls of said bottom member being folded upwardly from said bottom member base panel along said respective side wall fold lines to a position at least substantially perpendicular to said bottom member base panel, said side walls of said bottom member defining a peripheral side wall along said perimeter of said bottom member base panel, said top member and said bottom member being assembled in nested relation with said peripheral side walls in overlapping relation and said top member base panel supported on said interior support flap at least substantially in parallel with said bottom member base panel.

22. The foldably constructed force-resisting structure recited in claim 21 wherein said separable flap segments are folded inwardly toward one another from said attached flap segment to a position where said separable flap segments are disposed at least substantially parallel to one another and at least substantially at a right angle to said attached flap segment.

23. The foldably constructed force-resisting structure recited in claim 21 wherein said sheet material is corrugated paperboard.

* * * * *